US011806307B2

(12) United States Patent
Juto et al.

(10) Patent No.: US 11,806,307 B2
(45) Date of Patent: Nov. 7, 2023

(54) DEVICES, SYSTEMS AND METHODS FOR MECHANICAL TISSUE STIMULATION

(71) Applicant: ABILION MEDICAL SYSTEMS AB, Stockholm (SE)

(72) Inventors: Fredrik Juto, Stockholm (SE); Jan-Erik Juto, Stockholm (SE)

(73) Assignee: ABILION MEDICAL SYSTEMS AB, Stockholm (SE)

( * ) Notice: Subject to any disclaimer, the term of this patent is extended or adjusted under 35 U.S.C. 154(b) by 0 days.

(21) Appl. No.: 17/671,641

(22) Filed: Feb. 15, 2022

(65) Prior Publication Data

US 2022/0241140 A1 Aug. 4, 2022

Related U.S. Application Data

(63) Continuation of application No. 16/583,507, filed on Sep. 26, 2019, now Pat. No. 11,285,072, which is a (Continued)

(51) Int. Cl.
*A61H 9/00* (2006.01)

(52) U.S. Cl.
CPC ..... *A61H 9/0078* (2013.01); *A61H 9/0007* (2013.01); *A61H 2201/1246* (2013.01); (Continued)

(58) Field of Classification Search
CPC ..... A61H 9/0078; A61H 9/0007; A61H 2201/1246; A61H 2201/1607; (Continued)

(56) References Cited

U.S. PATENT DOCUMENTS 2,052,321 A * 8/1936 Smart ..... A61M 31/00 604/212
3,848,607 A 11/1974 Clair
(Continued)

FOREIGN PATENT DOCUMENTS

DE 20 2004 001869 U1 4/2004
EP 1729702 B1 9/2013
(Continued)

*Primary Examiner* — Kendra D Carter
*Assistant Examiner* — Arielle Wolff
(74) *Attorney, Agent, or Firm* — Ballard Spahr LLP

(57) ABSTRACT

A method of stimulating nasal tissues using a system comprises a catheter assembly connected to a fluid flow generator. The catheter assembly comprises a generally oblong inflatable catheter defining at least one catheter volume and a tube part comprising at least one lumen configured to establish fluid flow connection between said fluid flow generator and catheter. Preferably, the catheter assembly comprises at least one vent for releasing fluid or permitting fluid to escape from the generated fluid flow. The method generally comprises the steps of: providing a fluid flow from the fluid flow generator; inflating the catheter to assume a (Continued)

shape suitable for insertion in the nasal cavity; inserting the catheter to a predetermined position in a nasal cavity; adjusting the catheter with the fluid flow regulator to assume a shape suitable for stimulating the nasal tissue; and stimulating the nasal tissue by selecting at least one of a smooth continuous fluid flow, an oscillating fluid flow and a pulsating fluid flow.

10 Claims, 23 Drawing Sheets

Related U.S. Application Data continuation of application No. PCT/EP2018/058010, filed on Mar. 28, 2018.

(60) Provisional application No. 62/477,491, filed on Mar. 28, 2017.

(52) U.S. Cl.
CPC ..... *A61H 2201/165* (2013.01); *A61H 2201/1607* (2013.01); *A61H 2205/023* (2013.01)

(58) Field of Classification Search
CPC ..... A61H 2201/165; A61H 2205/023; A61H 2201/0103; A61H 2201/5071; A61H 21/00
See application file for complete search history.

(56) References Cited

U.S. PATENT DOCUMENTS

| | | | | |
|---|---|---|---|---|
| 5,025,805 | A * | 6/1991 | Nutter | A61M 16/0666 128/207.18 |
| 2011/0282251 | A1* | 11/2011 | Baker | A61M 16/0434 601/2 |
| 2012/0253284 | A1 | 10/2012 | Nitsan et al. | |
| 2013/0158450 | A1* | 6/2013 | Juto | G16H 20/70 601/46 |
| 2013/0158451 | A1 | 6/2013 | Juto et al. | |
| 2013/0253388 | A1* | 9/2013 | Juto | A61H 23/04 601/48 |
| 2017/0007810 | A1 | 1/2017 | Parsons et al. | |

FOREIGN PATENT DOCUMENTS

| | | |
|---|---|---|
| SU | 1 560 205 A1 | 4/1990 |
| WO | 2013/139645 A1 | 9/2013 |

* cited by examiner

DEVICES, SYSTEMS AND METHODS FOR MECHANICAL TISSUE STIMULATION

CROSS REFERENCE TO RELATED APPLICATIONS

This application is a continuation of U.S. application Ser. No. 16/583,507 filed Sep. 26, 2019, which is the continuation of International Application No. PCT/EP2018/058010, filed 28 Mar. 2018, which claims priority to U.S. provisional patent application Ser. No. 62/477,491, filed 28 Mar. 2017, the entire contents of which are hereby incorporated by reference.

BACKGROUND OF THE INVENTION

Field of the Invention

The invention generally relates to mechanical tissue stimulation in body cavities in humans or other mammals. The present invention relates to devices, systems and methods for mechanical tissue stimulation, such as kinetic oscillation stimulation (KOS).

Description of Background

Sometimes the nervous system is involved in a disease process in the body. In other cases, the nervous system is a vector for affecting a disease process somewhere in the body. Tissue and nerve stimulators can be used to modulate disease processes where the nervous system plays a role or can be used to reach a part of the body playing a role in the disease process.

Mechanical or other tissue stimulators can be introduced in the nasal cavity or be used in other locations on or in the body. By placing a treatment probe in the nasal cavity, treatment can be administered to tissue and nerves that are not insulated by skin or other tissues that could serve to diminish treatment effectiveness. The nasal cavity is also in proximity to important nerves, such as the trigeminal nerve, olfactory nerve, sphenopalatine ganglion. Some of these nerves are important to the sympathetic and parasympathetic parts of the autonomic nervous system. Treatment in the nasal cavity can thus be administered without using a surgically invasive probe. The probe can be removed from the nasal cavity between treatment sessions.

Published clinical trials have found KOS treatment to have a beneficial clinical effect (e.g. Juto J E, Axelsson M. *Kinetic oscillation stimulation as treatment of non-allergic rhinitis: an RCT study*. Acta Otolaryngol, May 2014). It is also believed the treatment could be of benefit for other indications where the nervous system or inflammatory processes are involved, such as but not limited to Chronic Obstructive Pulmonary Disease (COPD), Dry Eye Syndrome (Keratoconjunctivitis Sicca), Rhinitis, Radiation Induced Inflammation, Migraine, Inflammatory Bowel Disease (IBD), and Sjogren's Syndrome, Chronic Kidney Disease (CKD), Depression, Chronic Fatigue Syndrome (CFS), Myocardial Infarction (MI), Artherosclerosis, Stroke, Rheumatic Arthritis, Multiple Sclerosis (MS), Parkinson's Disease, ALS.

Another example is Intranasal Stimulation for Treatment of Meinbomian Gland Disease and Blepharitis (US2017/0312521 A1), where a primarily electrical stimulation is delivered inside the nasal cavity. The stimulation according to the patent typically takes place 20-35 mm into the nasal cavity. The application describes intranasal electrical stimulation typically with a duration of 3-5 minutes, but sometimes up to 10 minutes. Holding a handheld stimulation device for such a duration of time can be tiresome. The application mentions stimulation by means of airflow but does not provide any enabling features to perform a therapy.

Mechanical tissue stimulators for use inside the nasal cavity to treat various diseases are known previously, for example Vibration Device (SE531172 C2). The patent discloses a device that is inserted into a body cavity in one state and then expanded into a second state before vibration treatment, i.e. it is too large to introduce through a nostril in its second state. It also describes a typical embodiment with a stabilizing section "suitably made of a silicone, plastic or rubber material" which can, however soft and flexible the material, still be uncomfortable to introduce in a nasal cavity.

It is desirable to have a solution where the catheter is as pliable and soft as possible, while it also has to be rigid enough to be possible to introduce in a body cavity. A common problem is that the treatment balloon is not inserted far enough into the nasal cavity, is pulled out to some extent due to the weight of associated tubing, is pushed out by forces from surrounding tissue, or other forces acting on the balloon. There is a need for convenient and practical means of fixating the position of a treatment device during treatment, which can take 10-15 minutes in each of two nostrils, such that treatment is not delivered in the wrong location to the detriment of desired clinical benefits. It is also desirable to have solutions that provide as many desirable features as possible while using as few expensive and heavy mechanical parts as possible.

SUMMARY

In a general aspect, the present invention is directed to a system for mechanical stimulation of nasal tissues of a patient, comprising a catheter assembly connected to a fluid flow generator. The catheter assembly comprises a generally oblong inflatable catheter defining at least one catheter volume and the catheter is configured to assume a shape suitable for insertion into a nasal cavity and to assume a shape suitable for stimulating a nasal tissue. The catheter assembly also comprises a tube part comprising at least one lumen configured to establish fluid flow connection between said fluid flow generator and catheter. Preferably, the catheter assembly comprises at least one vent for releasing fluid or permitting fluid to escape from the generated fluid flow.

In one aspect, the at least one vent of the system is capable of being manually or mechanically obstructed.

In one aspect, the at least one vent of the system is positioned on the tube part.

In one aspect, the at least one vent of the system is positioned on the catheter.

In one aspect a plurality of vents can be distributed on the catheter in order to provide a cushioning effect to support nasal insertion.

In one aspect, a plurality of vents are located on the distal, tip part of the catheter.

In one aspect of the system, at least one vent is configured so an external force on the catheter can deflate the catheter.

The fluid flow generator of previous aspects of the invention is configured to generate at least one of a smooth continuous flow, an oscillating flow and a pulsating flow. The fluid flow generator comprises at least one of a pump, a diaphragm pump, a check valve, a three-way valve, a means for dampening pulsations and/or oscillations of the flow, a pressure sensor, and a control device for controlling pumps and sensors.

In one aspect, the fluid low generator comprises a first pump configured to generate a smooth, continuous flow and a second pump configured to generate a pulsating and/or oscillating fluid flow.

In one aspect of the fluid flow generator as used with inventive system, the means for dampening pulsations and/or oscillations of the flow is a Helmholtz resonator connected to a pump, or a muffler comprising a tube-shaped device or a cavity.

In one aspect, the catheter of the system comprises at least one of the following features: one or more segments that transmit oscillations and pulsations of the fluid flow to the nasal tissue; one or more segments that dampen or eliminate oscillations of the fluid flow; one or more elastic segments that expand the catheter size as a result of increase fluid pressure or fluid flow pulsation; a rigid element preventing the catheter from flexing in predetermined directions; a distal tip part made of material more hydrophobic material than the remaining catheter and folds or protrusions configured to stabilize a position in the nasal cavity.

In one aspect, the catheter assembly of the system, comprises a support structure between the tube part and the catheter, for handling and/or stabilizing the catheter assembly. This support structure comprises at least one of the following features: a pair of knobs protruding in parallel to the catheter and configured to extend into nostrils; means for connection to the tube part; and one or more controllable vents for controlling the catheter pressure or rigidity, for example controllable manually or mechanically.

In one aspect, the system comprising a catheter assembly comprises a tube part with a first tube having a first lumen in fluid connection with the fluid flow generator and to the catheter and a second, preferably shorter, tube having a second lumen connected to the catheter and to ambient air, wherein the catheter is configured to admit a fluid flow from the first to the second lumen. According to this aspect, the catheter can have a partition between a first catheter volume receiving the fluid flow from the first lumen and a second catheter volume receiving the fluid flow from said first catheter volume and connected to the second lumen. According to this aspect, the first and the second lumens can be coaxially arranged in the tube part. Further, according to this aspect, the diameter of second lumen can be smaller than the first lumen. Further to this aspect, the fluid flow generator can comprise a diaphragm pump and pump connected to a Helmholtz resonator and a check valve, a pressure sensor and control device for controlling the pumps and the sensor. Further to this aspect, at least one of the first and the second tube is configured to be fixated to the ears. At least one of the first and the second tube can comprise at least one fluid conducting connector permitting controlled rotation of at least one of the first and the second tube. Further according to this aspect, the support structure can comprise a support tube configured for fixation to the ears. The mentioned connector can be arranged to connect the support tube with at least one of the first and the second tube.

In another general aspect the invention is directed to a method of stimulating nasal tissues using a system comprising a catheter assembly as previously described. The method generally comprises the steps of: providing a fluid flow from the fluid flow generator; inflating the catheter to assume a shape suitable for insertion in the nasal cavity; inserting the catheter to a predetermined position in a nasal cavity; adjusting the catheter with the fluid flow regulator to assume a shape suitable for stimulating the nasal tissue; and stimulating the nasal tissue by selecting at least one of a smooth continuous fluid flow, an oscillating fluid flow and a pulsating fluid flow.

In one aspect of the method smooth continuous fluid flow is provided when inflating the catheter and/or inserting the catheter in the nasal cavity.

In one aspect of the method an oscillating fluid flow and/or a pulsating fluid flow is provided when inserting the catheter into the nasal cavity The method as previously described can comprise stimulating the nasal tissue with an oscillating fluid flow and/or a pulsating fluid flow for 3 to 25 minutes or at least 10 minutes.

The method as previously described can comprise controlling the catheter pressure and/or the catheter rigidity with at least one controllable vent. Such a vent can be obstructable manually or mechanically In addition, or alternatively, the catheter pressure and/or rigidity can also be controlled by the flow generator, for example by adjusting a pump generating a smooth continuous flow to increase or decrease the catheter pressure, while maintaining an oscillating and/or pulsating flow generated by an additional pump.

In one aspect, the method can comprise stabilizing the catheter assembly over the ears.

In one aspect, the method can comprise stimulating the nasal tissue, while permitting a fluid flow to exit from the at least one vent.

In one aspect of the method, a fluid flow rate is provided from the generator of about 700 to 2000 ml/min at zero pressure and a flow rate of 500 to 1500 ml/min at 100 mbar pressure; the flow rate in the catheter assembly will be lower than this upper limit due to fluid impedance.

In one aspect of the method, it comprises a pulsating or oscillating fluid flow with a main frequency in the range of 10 to 100 Hz.

The features of the inventive system and methods are further described or defined in the following section of the description, wherein any embodiments or configurations shall without limitation be regarded as parts of the present invention.

BRIEF DESCRIPTION OF THE DRAWINGS

Catheter Assembly with Directed Fluid Flow

Catheter Configurations

Figure 12B:
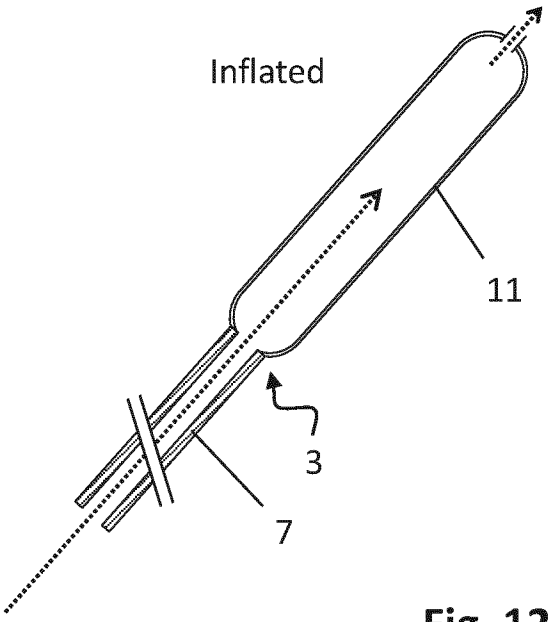
Figure 12A:
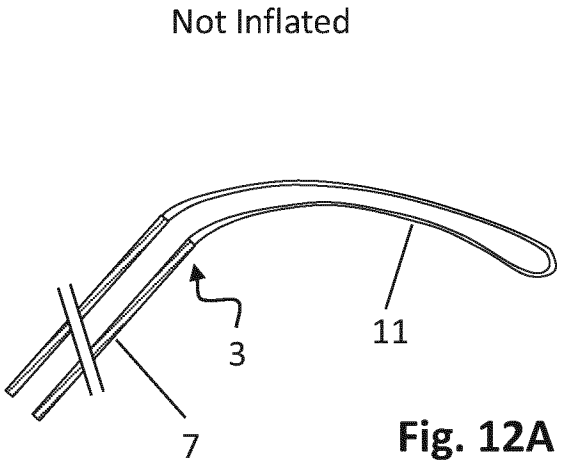
Figure 12C:
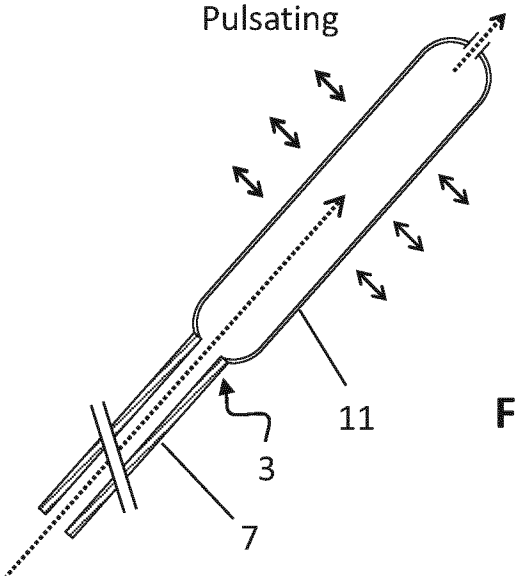

FIGS. 12A-C are schematic illustrations an example of a catheter in three states, non-inflated (without structural rigidity), inflated (providing some measure of rigidity), and pulsating.

Figure 13:
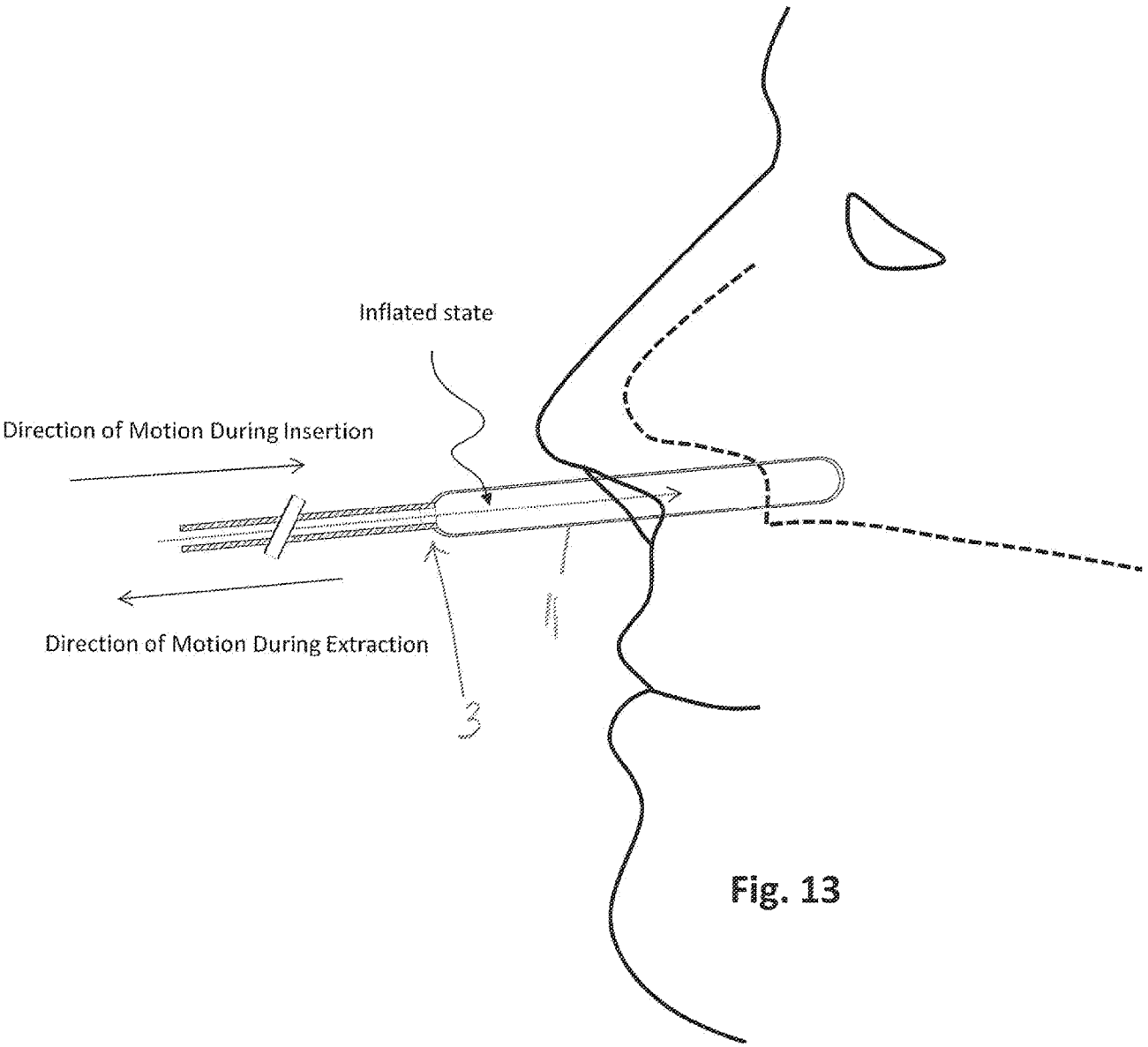

FIG. 13 is a schematic illustration of how a catheter without vents can be inserted into or extracted from a nasal cavity.

Figure 14B:
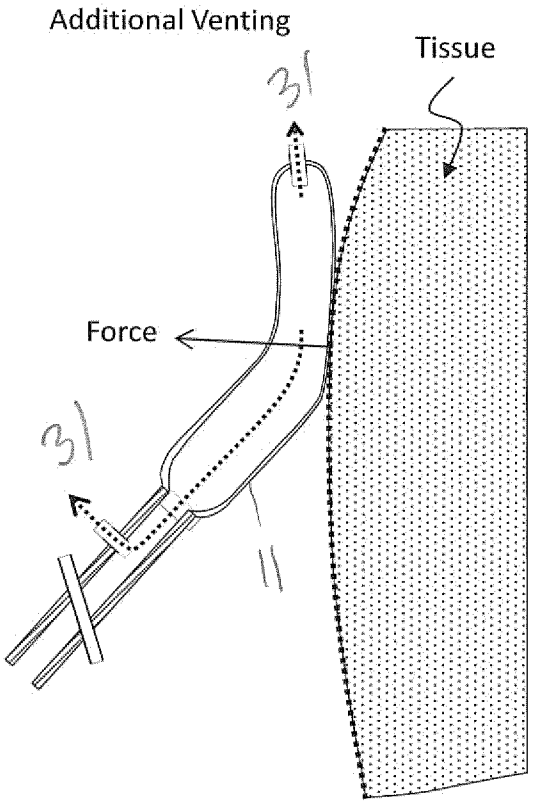
Figure 14A:
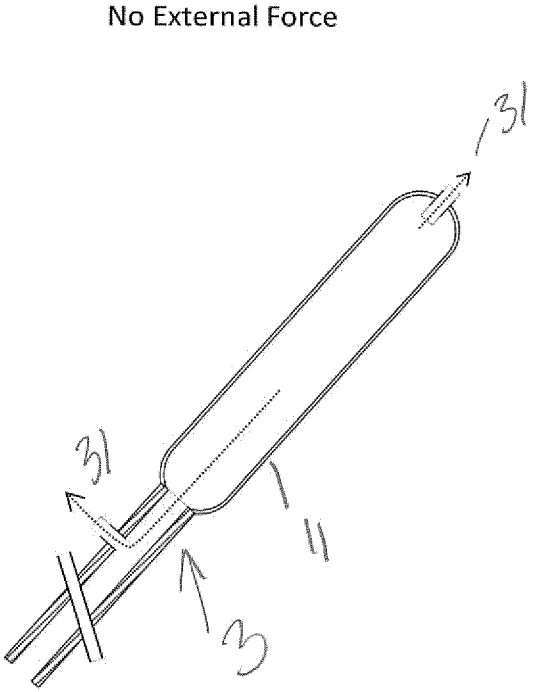

FIGS. 14A-B are schematic illustrations showing an example of a catheter assembly where vents close to or on the catheter provide a way for the catheter to quickly give way when faced with an external force, such as nasal tissue.

Figure 15:
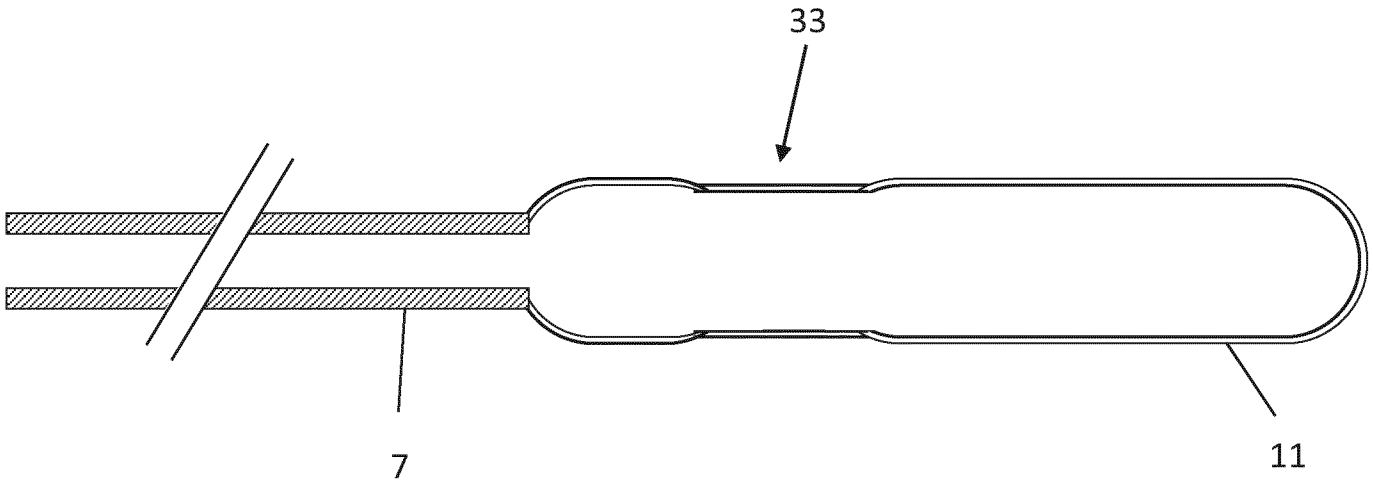

FIG. 15 is a schematic illustration showing an example of a catheter with a segment with limited oscillations.

Figure 16:
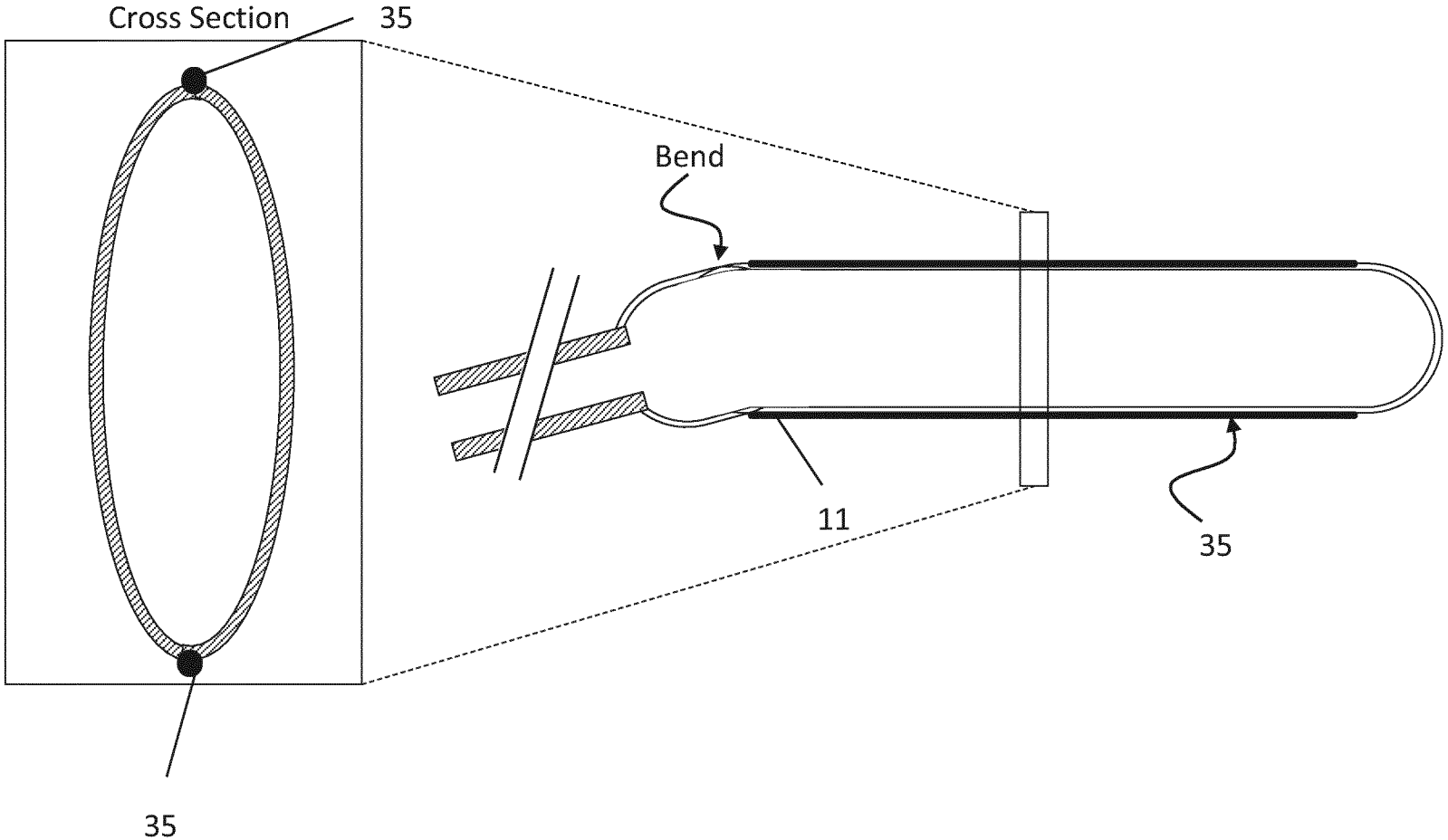

FIG. 16 is a schematic illustration showing an example of a catheter with two rigid elements that prevent flexing in the vertical direction.

Figure 17:
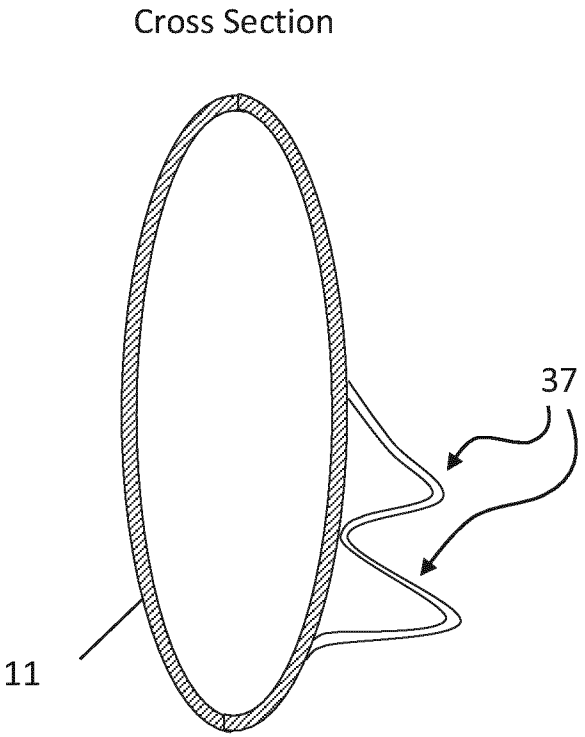

FIG. 17 is a schematic illustration showing an example of a catheter with folds on one side.

Generator System

Figure 18:
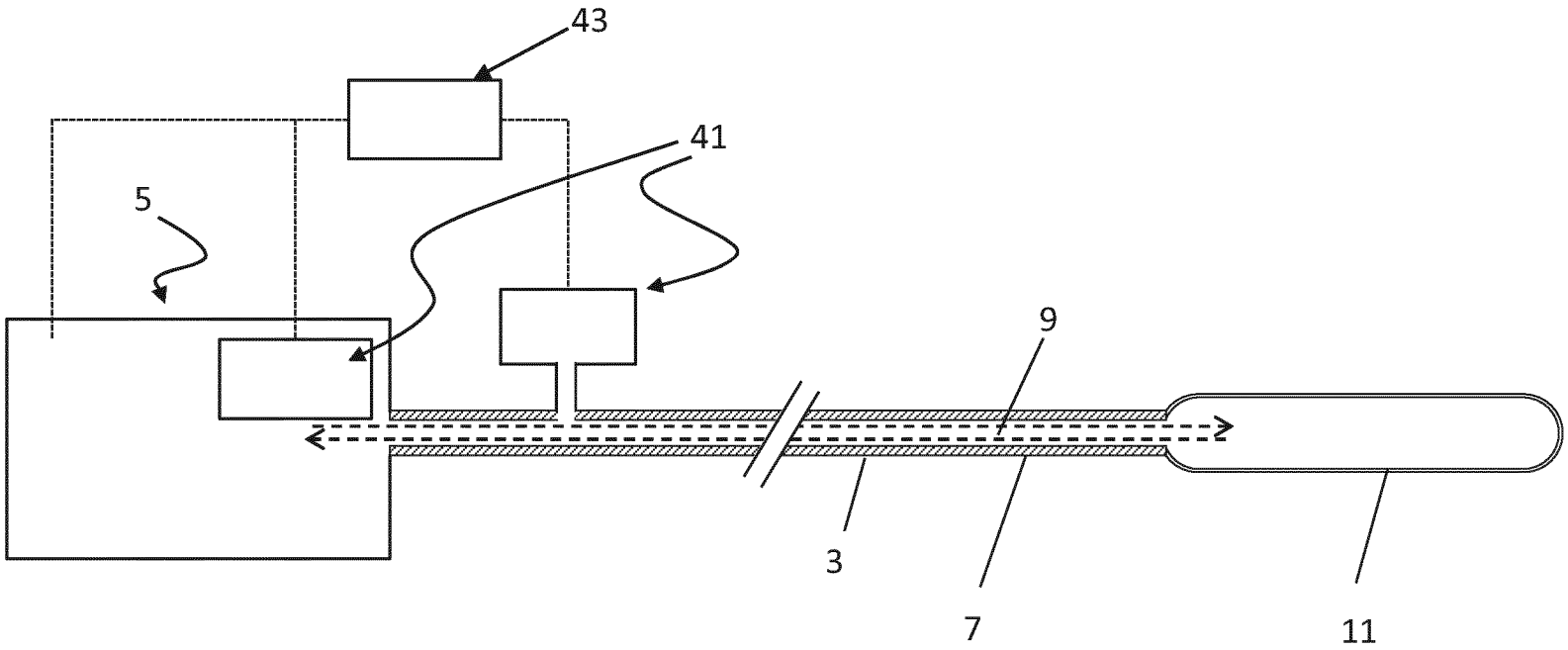

FIG. 18 is a schematic illustration showing an example of a system with a generator, a pressure sensor, a logic unit, and a catheter assembly with a single-lumen tube and a single-volume catheter.

Figure 19:
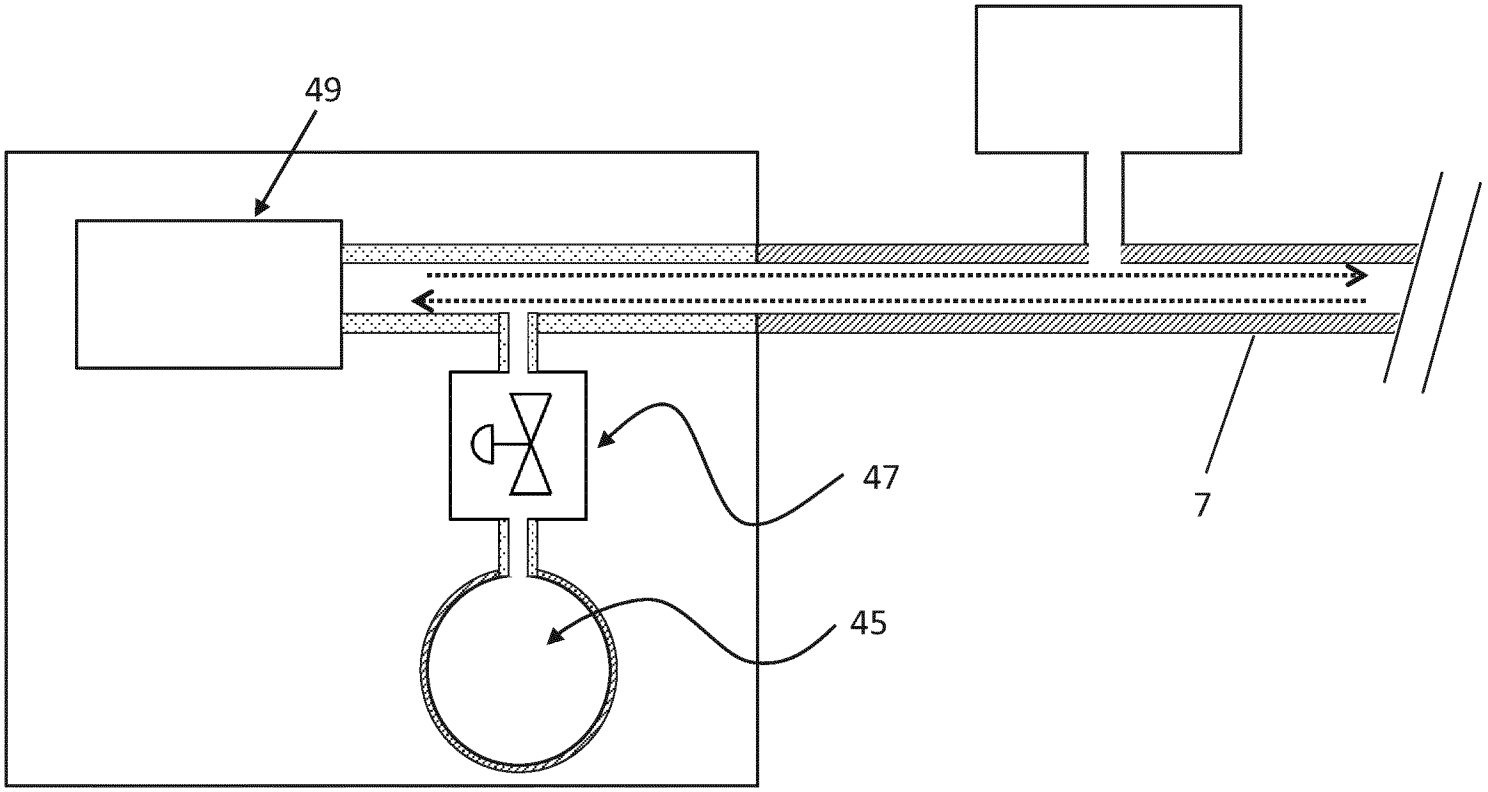

FIG. 19 is a schematic illustration showing an example of a generator with a pump and a Helmholtz resonator that can be connected or disconnected by a valve.

Figure 20:
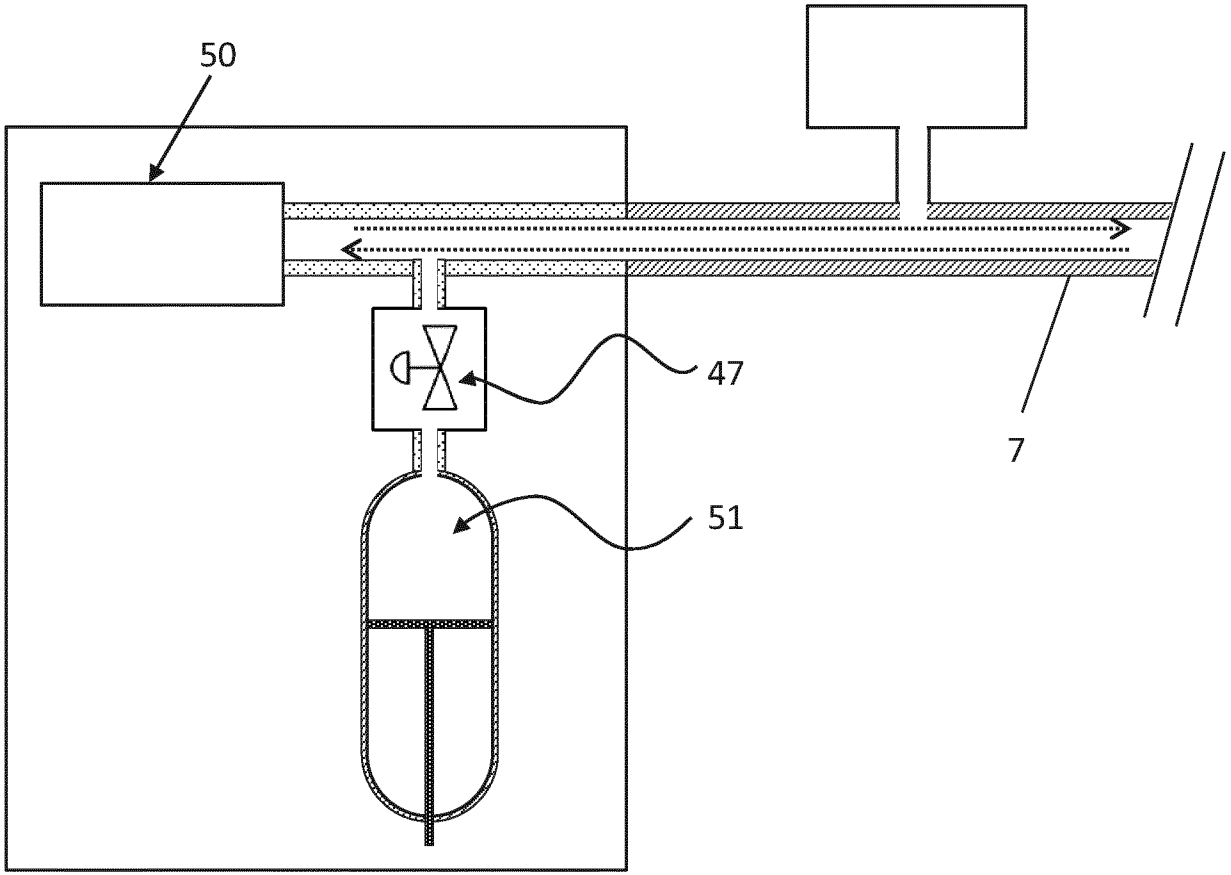

FIG. 20 is a schematic illustration explaining an example of a generator with a diaphragm pump and a variable-volume Helmholtz resonator that can be connected or disconnected from the outflow from the pump.

Figure 21:
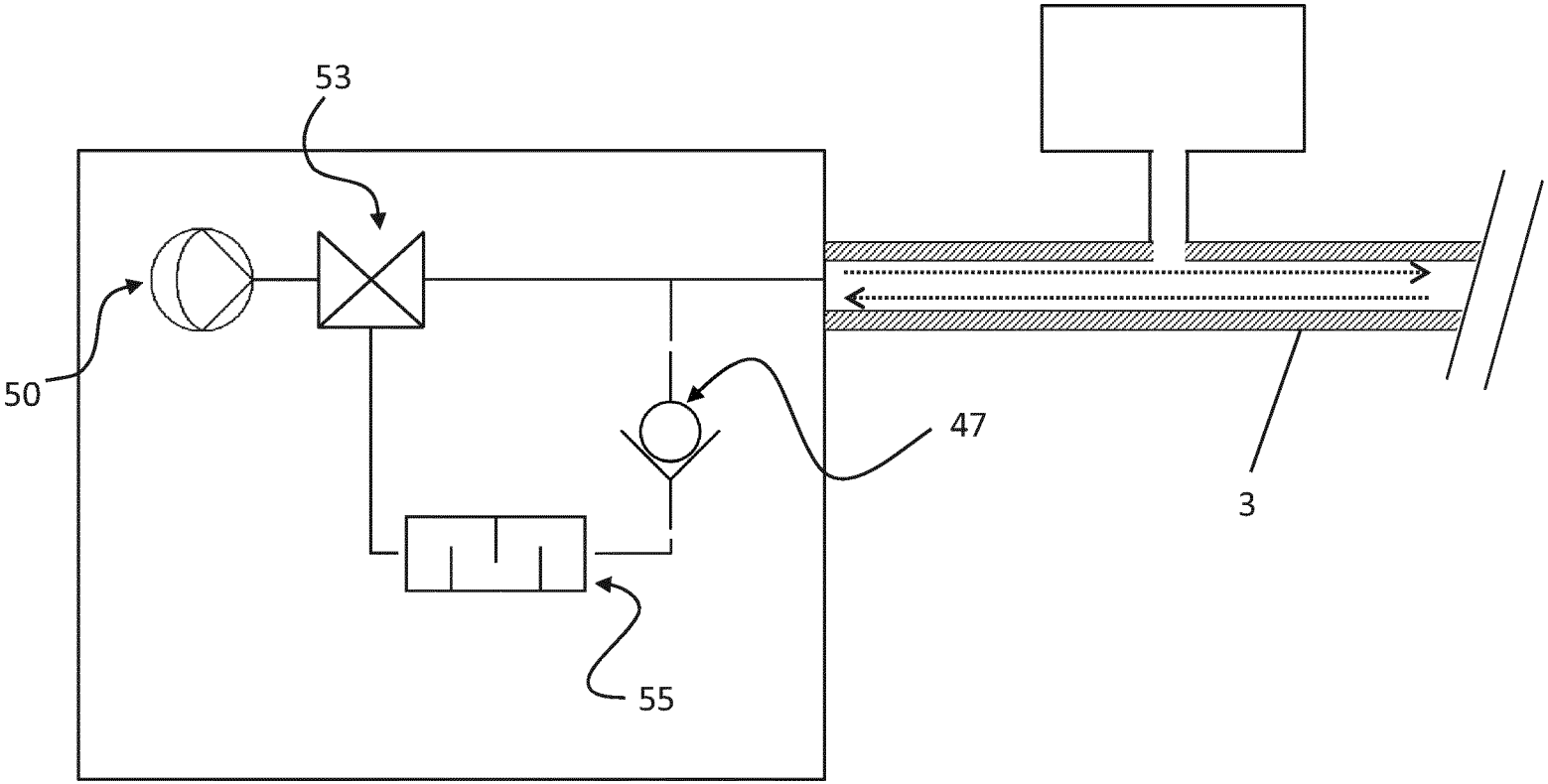

FIG. 21 is a schematic illustration showing an example of a generator with one diaphragm pump producing a pulsating flow that can, by means of a three-way valve, be directed to the catheter assembly directly or to the catheter assembly by means of a muffler.

Figure 22:
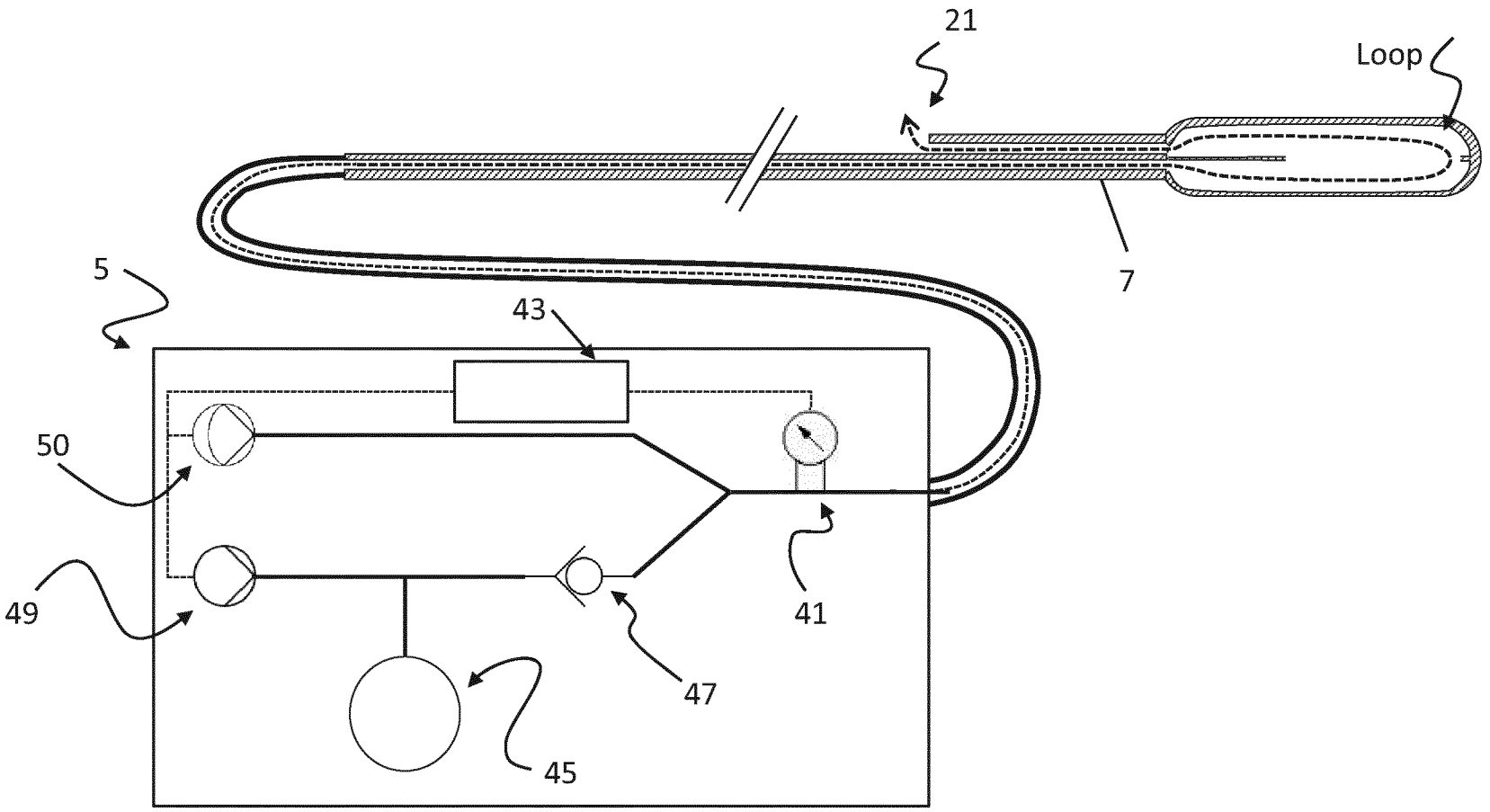
Figure 23:
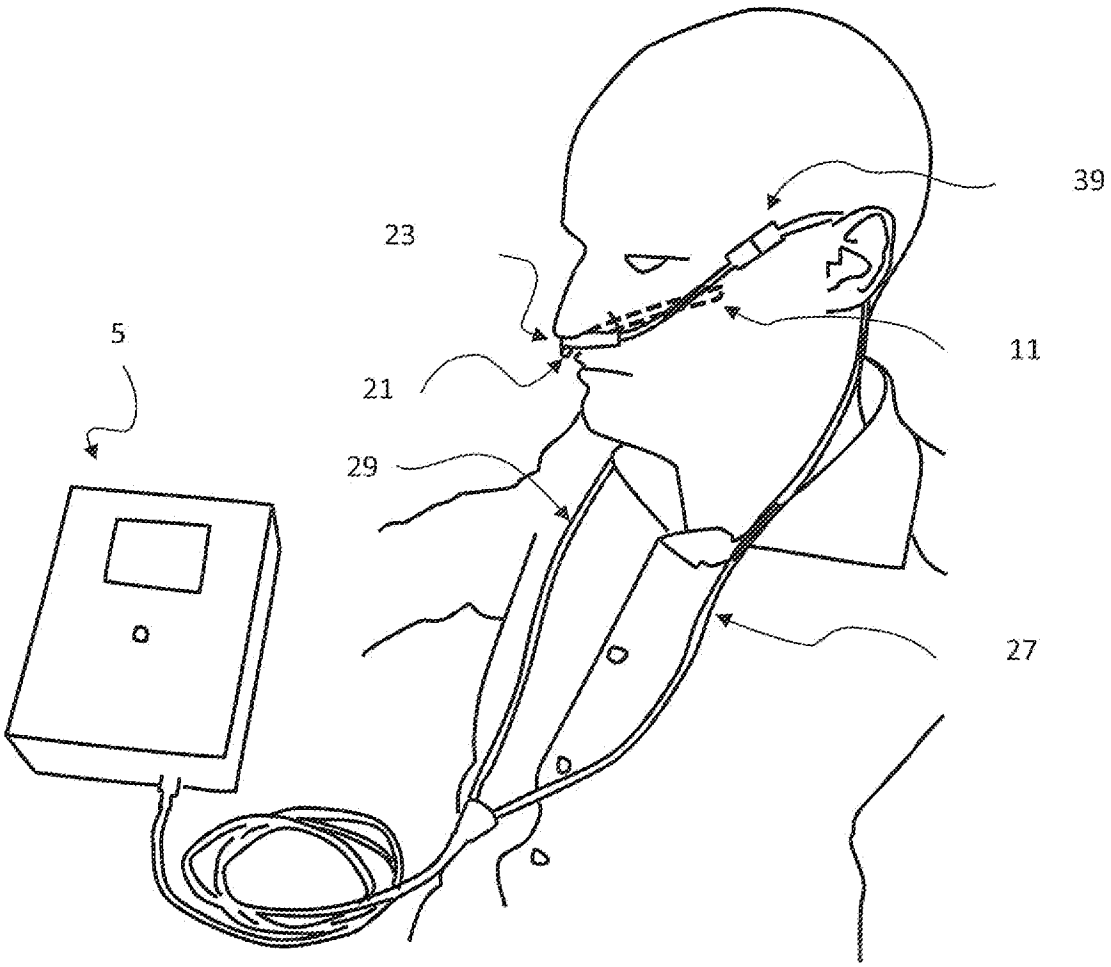

FIG. 22 is a schematic illustration showing an example of a generator with two pumps for pulsating flows and smooth flows, respectively, where the output from the pump for smooth flows passes by a Helmholtz resonator and through a check valve. FIG. 23, is schematic illustration showing a system that consists of a generator and a catheter assembly, where the generator is used to inject fluid into the catheter assembly.

DETAILED DESCRIPTION OF PREFERRED EMBODIMENTS

An object of the present invention is to provide novel systems and devices for the safe and convenient treatment using mechanical tissue stimulation for therapeutic use.

System for Delivering Mechanical Stimulation of Nasal Tissues

Figure 1:
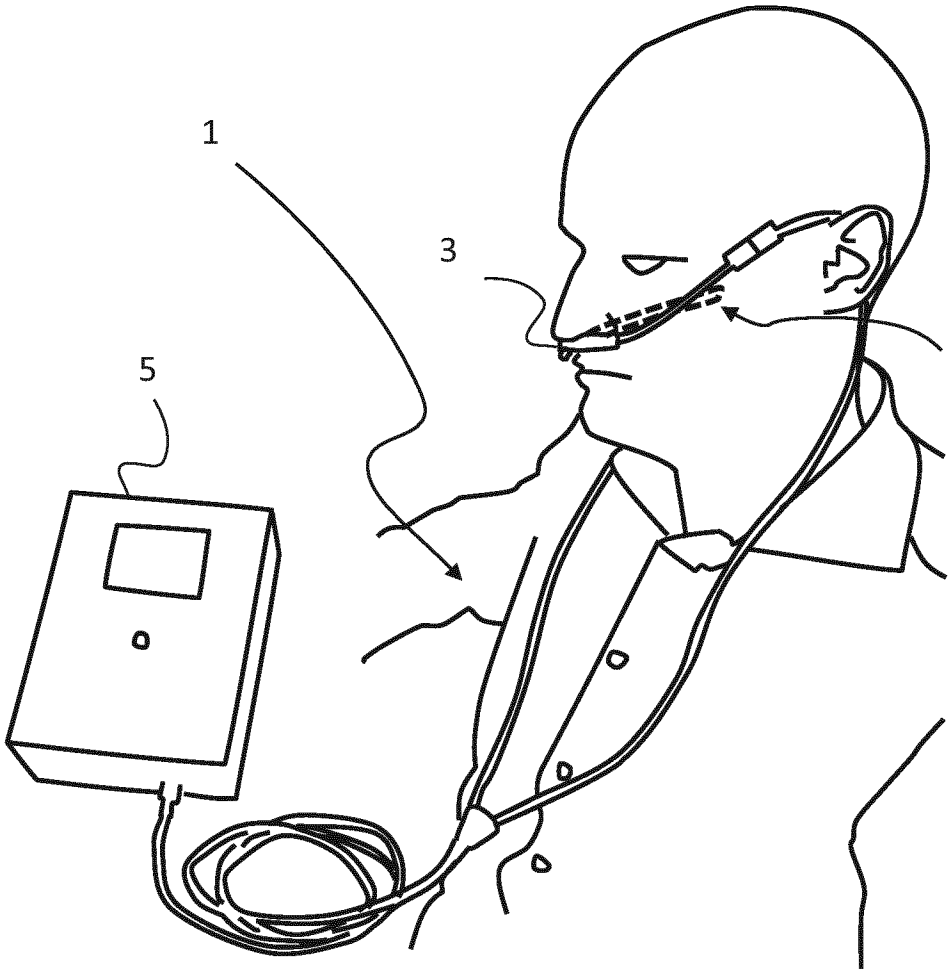
FIG. 1. shows a schematic illustration of the system for mechanical stimulation of nasal tissues.

FIG. 1, is a schematic view of a person using a system for delivering mechanical stimulation of nasal tissues; the system 1 for delivering mechanical stimulation of nasal tissues comprising a catheter assembly 3 connected to a fluid flow generator 5.

Catheter Assembly with Directed Fluid Flows

Figure 2:
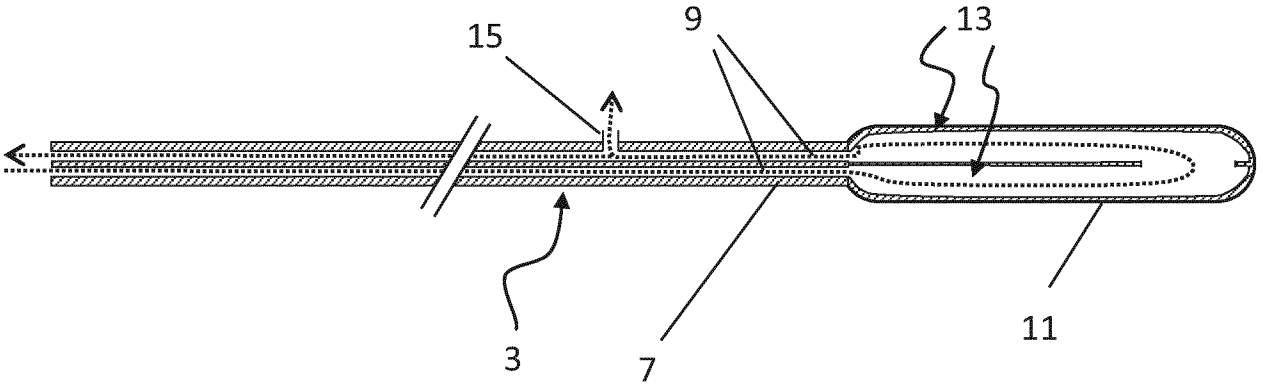
FIG. 2 is a schematic illustration explaining an example of a catheter assembly with a tube with two lumina and a catheter with two catheter volumes.

The catheter assembly 5, as shown in FIG. 2, comprises one or more tubes 7, or similar structures capable of containing fluid carrying lumina, with at least one internal lumen 9, and a catheter 11, with at least one inflatable catheter volume 13, such that a fluid can be transferred through the lumen/lumina to the volume(s) to inflate the catheter. It can be desirable that the catheter abuts against biological tissue.

The catheter can, in one embodiment, be constructed from materials that are smooth, slippery and flat, such that it easily slides in and out of body cavities without undue friction. It can be constructed using materials that are flexible and unable to support the shape of the catheter without an inside pressure above ambient. In a typical embodiment, the material of the catheter would not typically stretch elastically at the pressures typically present in the catheter assembly.

The catheter assembly comprises one or more vents 15, located on the tube 7, the catheter 11 or both, such that fluid can be injected continuously or intermittently into the catheter assembly through one or more lumen/lumina, permitting some pressurization, while fluid can escape through the vent(s). A vent could be a hole in the catheter material, a channel formed from the catheter material (e.g. formed when welding sheets of material together), a tube or other be implemented in a multitude of ways known to a person skilled in the art.

The fluid flow can be predominantly smooth, oscillating (back and forth) or pulsating (in one direction with variable speed), the flow typically pulsating mono-directional such that the oscillations are between different forward speeds or between different pressures that are all above ambient. It is understood that "pulsative" could also mean oscillating with little or no net flow in the context of this invention. Smooth flows are likely less noticeable or sensed less strongly by a patient, and can be preferable, e.g. during insertion and extraction of the catheter from a body cavity. Oscillating or pulsating flows can cause the device to vibrate or otherwise stimulate tissue against which it abuts which may or may not be desirable.

The vents can, in one embodiment, be located in such a way that the oscillating or pulsating fluid flow through vent(s) on the catheter can stimulate tissue in close proximity or in contact with the catheter vent(s). The catheter surface itself need not vibrate in this case, or could vibrate alongside the oscillating fluid flows, FIG. 3.

Vent Position

Figure 3:
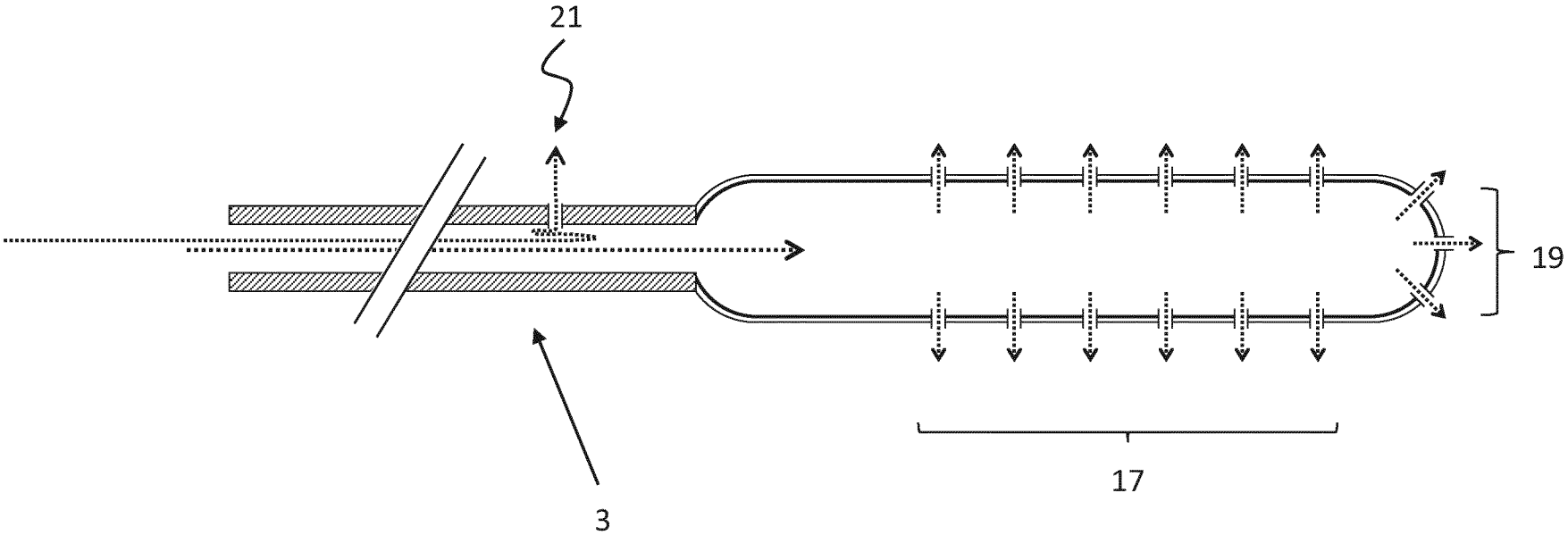
FIG. 3 is a schematic illustration showing different vent positions.
Figure 4:
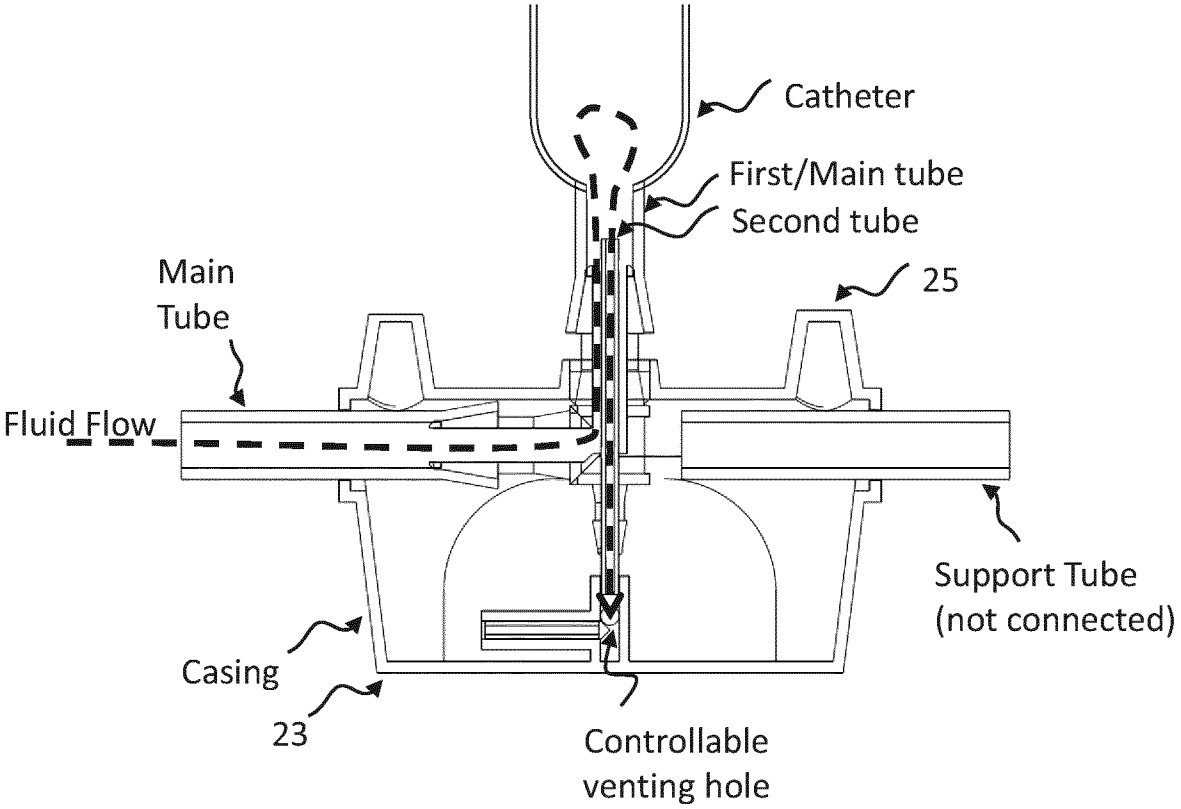
FIG. 4 is a schematic illustration of a catheter assembly comprising knobs for substance delivery.

As shown in FIG. 3, vent(s) on a catheter assembly 3 can be placed in several different positions. FIG. 3 shows vents on the sides of the catheter 17, vents on the tip of the catheter 19 and vents on the tube 21. Vent(s) on the catheter of the catheter assembly can be advantageous as it, through a cushioning effect, lubricates the interaction of the catheter and any tissue. A consequence of this arrangement is that fluid, typically a gas such as air, would be injected into the nasal airways of a person, which may or may not be desirable.

In some cases, it is desirable that a pharmaceutical in fluid or nebulized state, a gas with medical properties or other fluid is delivered to the patient, e.g. oxygen therapy, while receiving pulsative treatment, and in such cases some or all of that substance could be delivered through the mechanism of fluid flow in the present invention and any remaining substance delivered through other means, e.g. a face mask or possibly a support structure 23 where the present invention has been embedded. In some embodiments, such a substance can be delivered through channels (not shown) embedded in the knobs 25, where the substance may or may not be delivered through a separate lumen in the tube part. In such embodiments, it can be advantageous to have a mechanism for selecting one of the two knobs for substance delivery, where the channel in the other knob is closed. One such mechanism could be in the form of a lever mounted on a support structure that could easily be accessed when manipulating the catheter assembly (not shown). The lever would act so as to make sure that only one passage to a knob could be open or closed at any one time.

Figure 5:
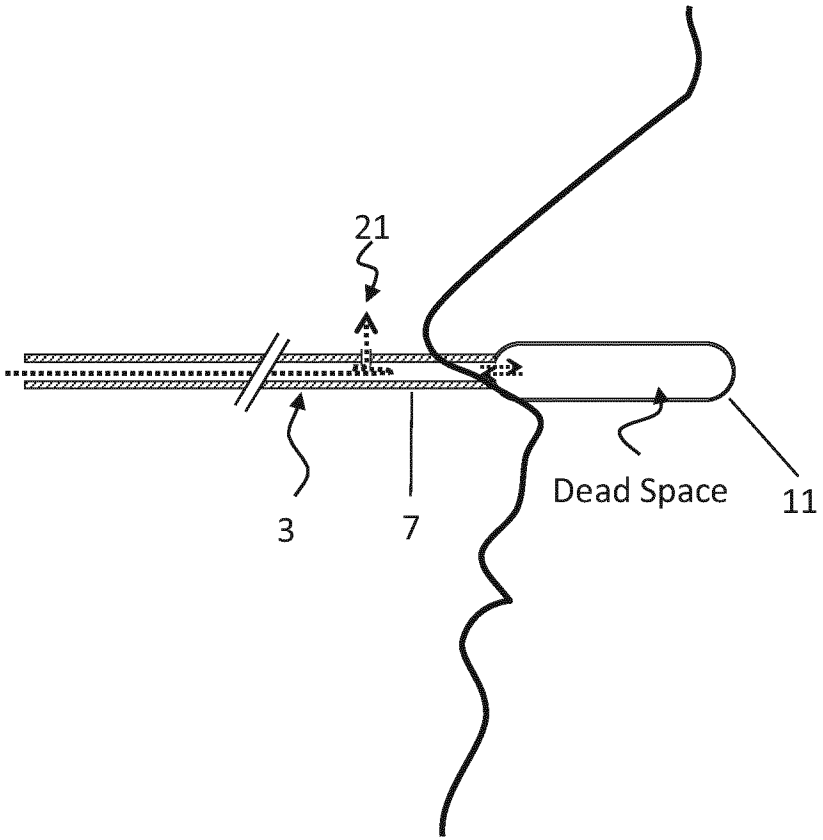
FIG. 5 is a schematic illustration explaining an example of a system where the catheter assembly has a single-lumen tube with a vent before the fluid reaches the catheter and its volume.
Figure 6:
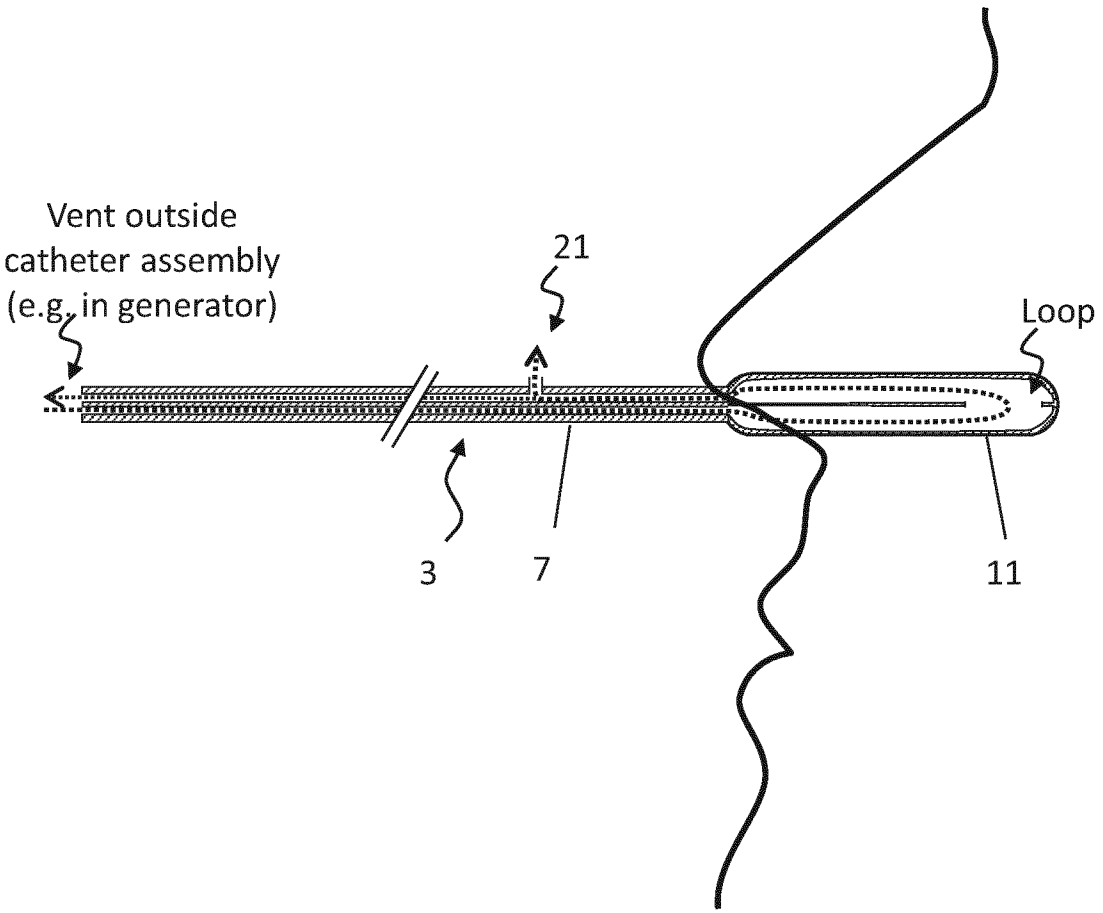
FIG. 6 is a schematic illustration explaining an example of a catheter assembly where fluid flows in a loop through the catheter volume(s).

If vent(s) are placed on the catheter assembly, e.g. on the tube, such that fluid flowing in a lumen toward the catheter 11 will reach the vicinity of a vent, such that fluid can escape through the vent without first arriving at the catheter volume, then there need not be a net fluid flow to the catheter volume and the catheter could optionally be made without vents, preventing the injection of fluid into the nasal airways, as shown in FIG. 5. Even with little or no net flow, any pressurization of in such a tube could still pressurize the catheter, and a pulsative flow in the tube could lead to oscillations in the fluid contained in the catheter and thus the catheter surface. If fluid is flowing to and from a catheter volume through different lumina, with any vent(s) placed on the lumen leading fluid away from the catheter, then fluid could flow through the catheter on its way through the catheter assembly. If more than one lumen is used, these could be in the same or different tubes. The lumens could be side-by-side, or coaxial if one lumen inside a tube is inside another lumen for all or part of the Catheter Assembly. FIG. 6 schematically shows an example of a catheter assembly 3 where fluid flows in a loop through the catheter volume(s).

Nozzle Cushion

Figure 7:
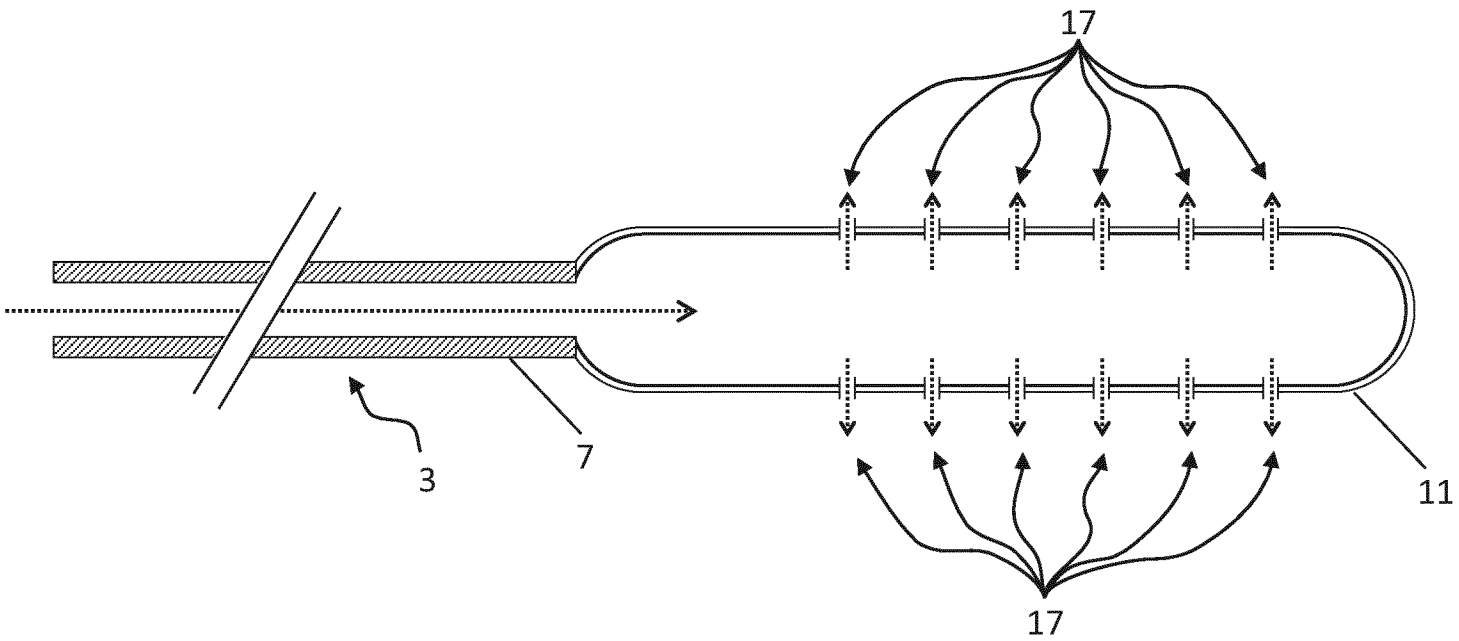
FIGS. 7 and 8 are a schematic illustration showing examples of catheters with vents placed to create a cushioning effect.
Figure 8:
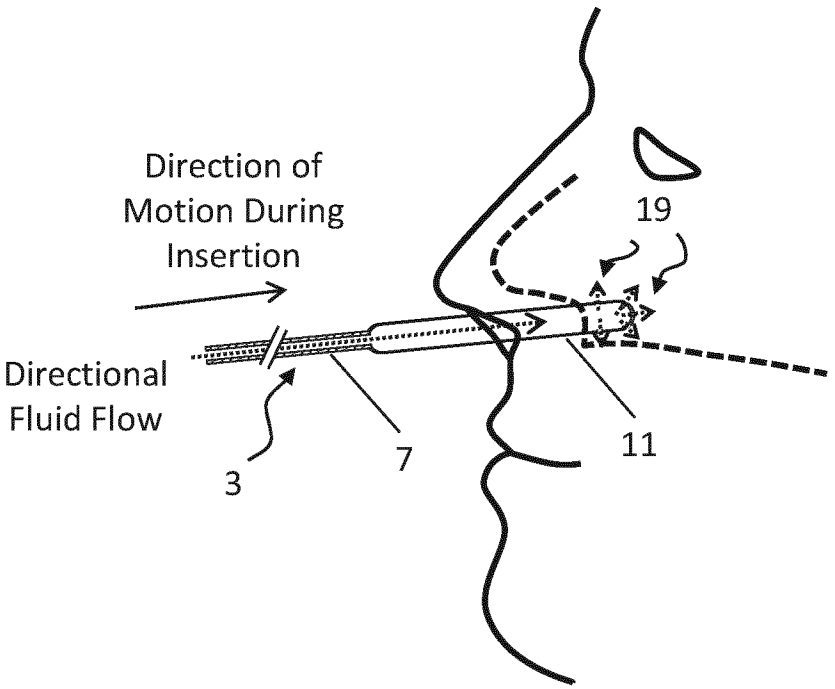
Figure 9:
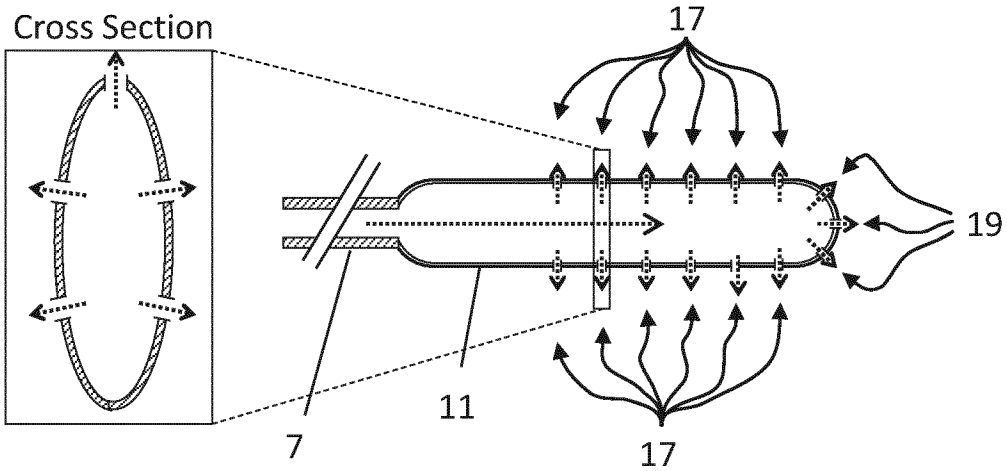
FIG. 9 is a schematic illustration explaining an example of a catheter that is flattened, with vents on either side.

In one embodiment illustrated in FIG. 7, vent(s) is/are located on the catheter 11, such that when fluid is injected into the catheter assembly 13 the fluid escaping through this/these vent(s) provide(s) a cushion that can serve to minimize the physical contact made between a catheter and tissue, reducing any discomfort felt by the patient while the positioning device is being inserted, extracted from body cavity, removed or applied externally. The catheter can be configured such that the discomfort-reducing effect is improved, for example, as shown in FIG. 8, by the concentration of the vents to the distal part, or tip, of the catheter, whereby the cushioning effect is concentrated to the part of the catheter which is most likely to come into physical contact with tissue head on, or as shown in FIG. 9, by having a flattened form, creating a cushioning effect on either side of a catheter introduced into a nasal cavity, which tends to be narrow.

In one embodiment, there are one or more vents on the upper side of the catheter, such that fluid escaping in that direction could stimulate tissue in the upper side of the nasal cavity.

Hydrophobic Tip

In one embodiment, a catheter can be made of hydrophobic material or coated with hydrophobic material in whole or in part, such that small vents can be used to create a nozzle cushion without clogging from any secretions from the tissue. Such hydrophobic materials could be applied to the vents themselves or otherwise localized around the vents.

Selectively Applied Pulsation Dampener

In one embodiment, the catheter assembly contains one or more pulsation dampeners or mufflers that can reduce or eliminate oscillations or pulsations in fluid flowing in the catheter assembly, that would otherwise travel through and with the fluid to reach the catheter volumes and thus make the surface of the catheter vibrate. It is understood that these dampeners and mufflers can be similar in design and intent as similar parts inside the generator. The application of such pulsation dampeners or mufflers would be selectively controlled through a mechanical or electrical device, such that either therapeutically active oscillations or pulsations could be administered through the catheter, or an essentially smooth fluid flow (e.g. during insertion or removal of catheter). An example would be a Helmholtz resonator acting as a pulsation dampener connected to a lumen inside the catheter assembly through a mechanical valve, such that a user can switch between smooth flow (dampened) or oscillating or pulsating flow (not dampened) by opening or closing the valve (not shown).

Pulsation dampeners or mufflers attached to the catheter assembly could also serve as, or be part of, handles that the user can use to hold or otherwise control (e.g. by connecting to a support structure, fixation device, or similar) the physical position of the catheter assembly in general and the catheter specifically.

An embodiment with pulsation dampeners or mufflers connected to the catheter assembly could reduce the complexity of a generator system in the product system, enabling a generator system that is potentially smaller, more convenient, lower cost, lower weight, a combination thereof or otherwise advantageous.

Controlled Vent Impedance

In one embodiment, as shown in FIGS. 5 and 6, one or more controllable vents 21 are located on the tube 7 of the catheter assembly 3 such that during insertion of a catheter 11 in a body cavity, or during pulsative treatment, fluid flow through one or more of these vents 21 could be obstructed in whole or in part, e.g. with one or more fingers, and by thus changing the flow impedance experienced by the continuous or intermittent flow in the catheter assembly, change the pressure inside the catheter, such that the catheter becomes more or less rigid and hard. With a system based on continuous or intermittent flows through a catheter assembly such that fluid is vented after passing through some distance of tubing, fittings, catheter volumes and similar, the pressure in the system will depend on the distribution of fluid impedance along the fluid flow path, with the highest pressure typically near the source of above-ambient pressure (e.g. a pump in the generator), with some pressure drop through the tube in the catheter assembly and thus lower pressure(s) in the catheter volume(s), with the pressure reaching ambient as the fluid escapes through a vent. Increasing or decreasing the fluid impedance near the end of the fluid's path is one way to change the pressure in positions along that path, e.g. in the catheter. Varying the rigidity and hardness of the catheter could be advantageous by making insertion more practical or more comfortable.

Figure 10:
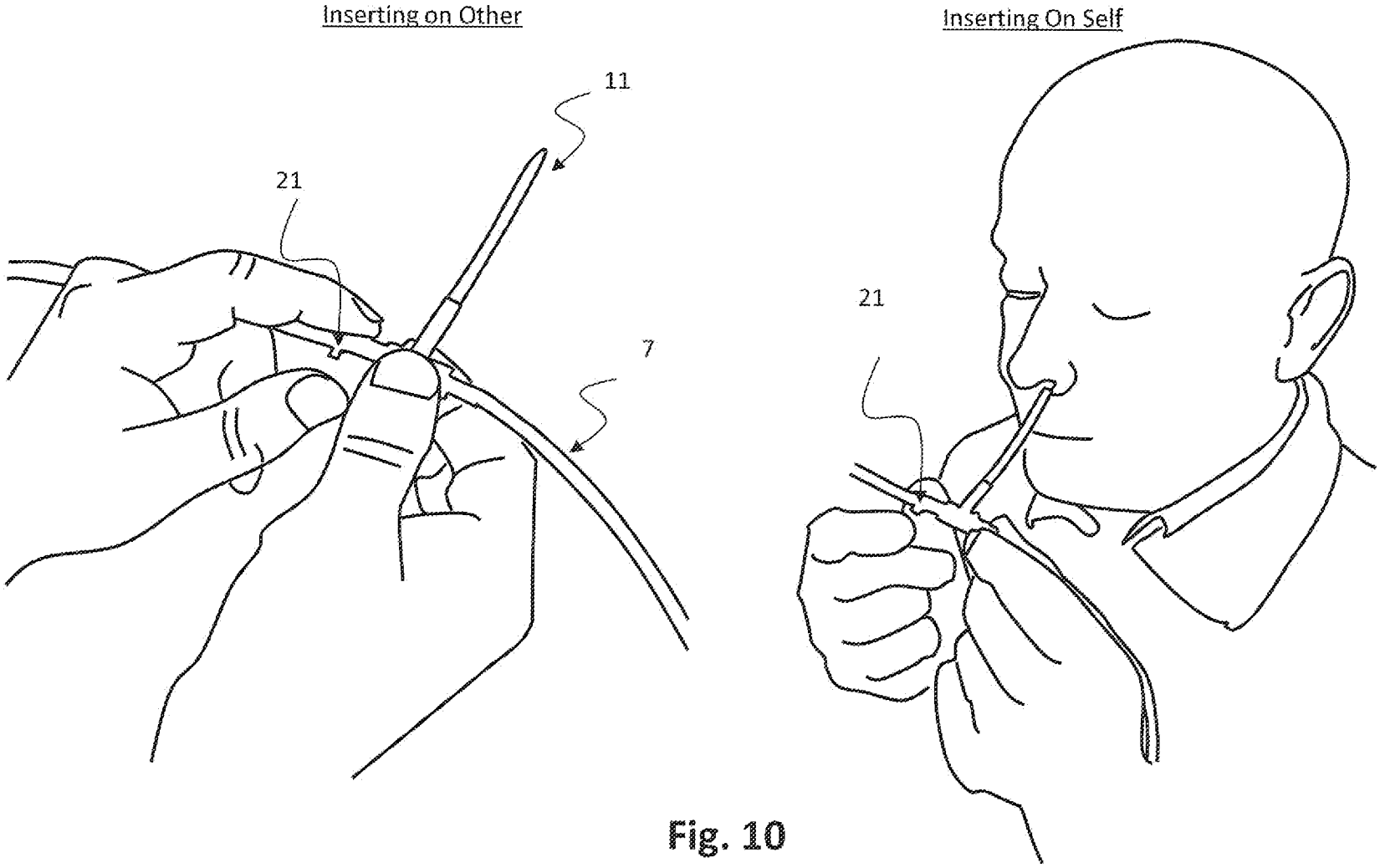
FIG. 10 is a schematic illustration of round vents that provide controlled impedance.

As shown in FIG. 10, in some embodiments, it can be advantageous if such a vent 21 consists of a round hole such that the vent can be easily obstructed in its entirety. In other cases, it can be advantageous if such a vent has a rectangular or wedge shape, such that the vent can more easily be covered in part, such that the flow impedance can be controlled in a linear or non-linear fashion.

In some embodiments, (not shown) the fluid impedance of such a vent can be controlled by means other than just the obstruction of a vent with a finger, such as by some mechanical or electromechanical part of the vent that can be configured to vary the fluid impedance. Such a mechanical part could for example be a piece of plastic that could be moved to different positions or angles of rotation and so obstruct the airflow to varying degrees. Such a mechanical part could obstruct part or all of the outlets from several vents. In some embodiments, such a piece of plastic could be moved with a finger but could then remain in the position selected with the finger and would so maintain the associated fluid impedance which in turn would maintain the associated inflationary pressure in the catheter. It is understood that several different designs for such a vent are possible and would be covered by the present invention.

It is understood that pressure inside the catheter assembly could be controlled not only by varying the fluid impedance of any controllable vents, but also by varying the fluid output from the generator. In some embodiments, such output variation could be controlled through a user interface presented on the generator. In can however be advantageous for reasons of cost and/or convenience to have a means of controlling the catheter pressure locally, near the nose, without having to use an electrical system to capture such user input and forward such a signal to the generator, and without having to interact with a user interface with a generator, which may be located some distance away e.g. on a table or similar.

Figure 11B:
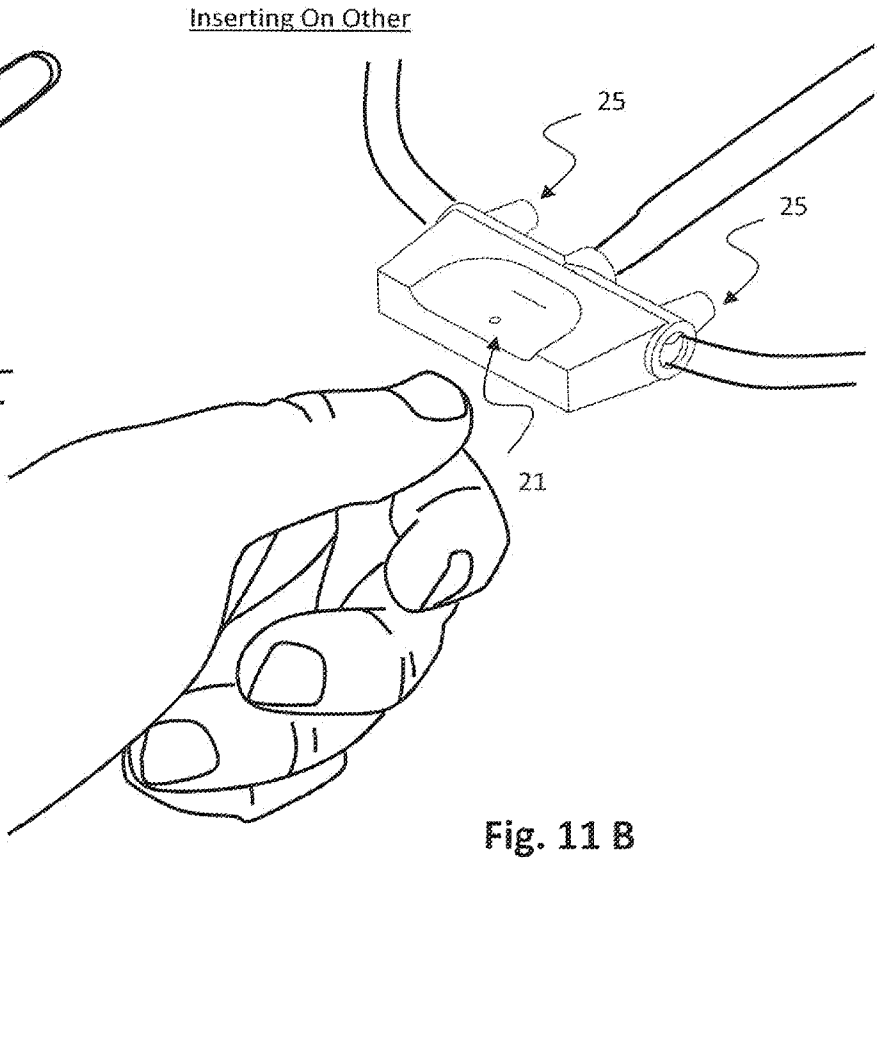
FIGS. 11A-B are schematic illustrations of vents located on support structures that provide controlled impedance.
Figure 11A:
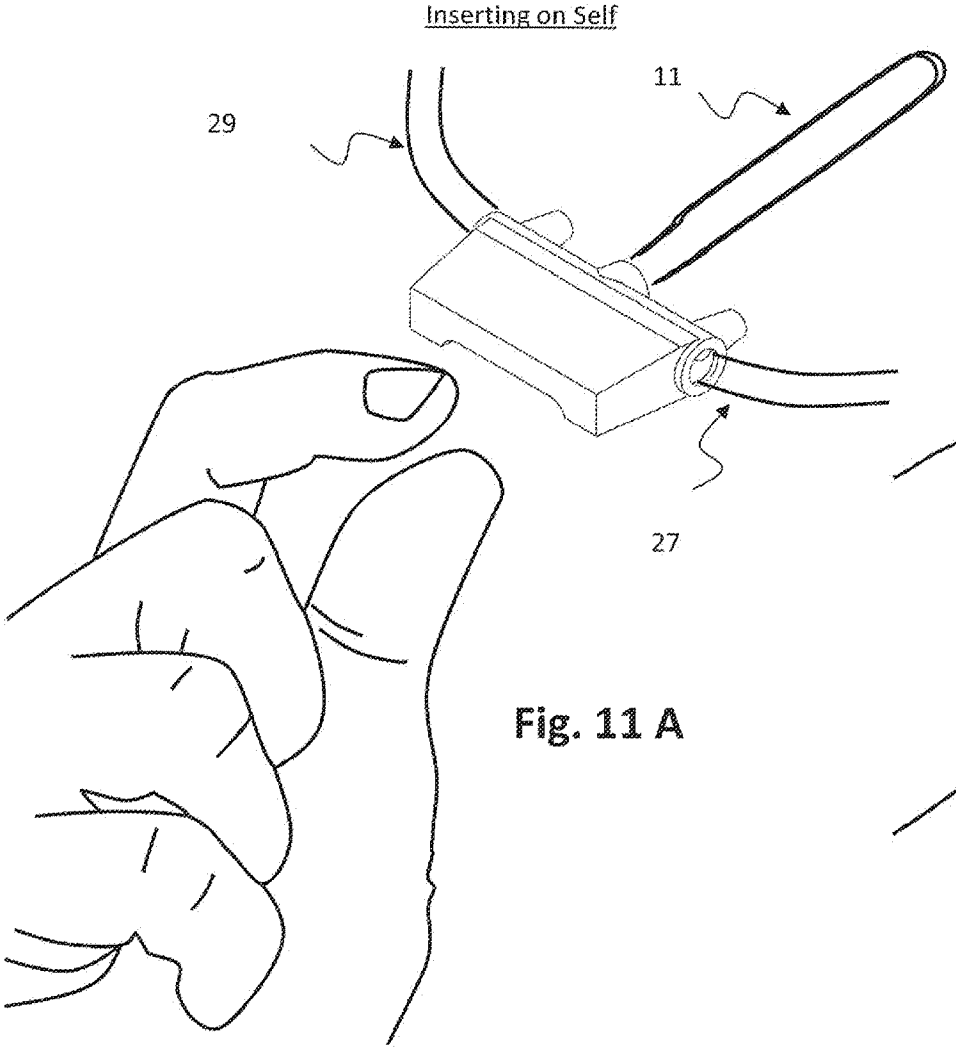

As shown in FIG. 11A, one or more controllable vents 21 can be located on the underside of the catheter assembly, such that a person holding the catheter assembly in order to introduce the catheter into his or her own nasal cavity could control the rigidity of the catheter with the thumb of the holding hand. In this embodiment, the catheter could typically be manipulated holding the catheter assembly with one hand.

In another embodiment, as shown in FIG. 11B, one or more controllable vent 21*s* can be located above the catheter assembly, such that a person holding a catheter assembly in order to introduce it into someone else's nasal cavity could control the rigidity of the catheter with the thumb of this holding hand. In this embodiment, the catheter could typically be manipulated holding the catheter assembly with one hand. In one embodiment, the same catheter assembly could be used either according to FIG. 11A or 11B, by flipping the catheter assembly over.

In one embodiment, one or more controllable vents are located pointing out from the catheter assembly such that a person holding the catheter assembly by the support structure or by the main tube 27 and/or a second tube 29 to introduce the catheter in a cavity could control the rigidity of the catheter with a finger. In some embodiments, when applying the device to oneself, an index finger could typically be used. In some embodiments, when applying the device to someone else, a thumb could typically be used. In this embodiment, it can be advantageous to hold the catheter assembly with two hands to firmly control the position of the catheter during insertion and extraction.

It is understood that the above descriptions recognize that a user may find various ways of holding the device and make use of the inventions described.

Catheter Configurations

By transferring fluid to a non-inflated catheter assembly 3, shown in FIG. 12A, to inflate it, the catheter can become sufficiently rigid to be more easily inserted into a body cavity such as the nasal cavity, shown in FIG. 12B. A third level of rigidity is reached when the catheter assembly 3 is in a pulsating state, see FIG. 12C.

Tissues in a body cavity such as the nasal cavity are very sensitive to physical contact, and it is desirable that any such contact be as soft as possible. As shown in FIG. 13, achieving rigidity by means of fluid transfer could make the catheter 11 rigid enough for insertion and yet permit it to be soft and pliable, as the catheter material is flexible and the fluid inside is malleable as well, reducing discomfort during insertion into a body cavity, compared to what could be the case e.g. if a more structurally rigid catheter were to be introduced into the cavity.

Similarly, a catheter assembly 3 with minimal or no inflation in the catheter can reduce discomfort as the catheter is being extracted from a body cavity. If a catheter assembly has at least minimal inflation, and perhaps more, and has vents, a cushioning effect can be created e.g. during the withdrawal which can make the extraction more comfortable, see FIG. 13.

It can be advantageous if the transition between the different levels of inflation and rigidity is smooth. It can similarly be advantageous if the transition between different pulsation frequencies (e.g. from 0 Hz to the operating frequency) is smooth.

As shown in FIGS. 14A-B, the catheter assembly 3 can be configured, by having one or more vents 31 placed such that fluid impedance of the channel connecting the vent and the catheter is limited, (e.g. vents placed relatively close to or on the catheter), such that an external force applied against the catheter could lead to fluid escaping at a higher rate through the vent(s), making the catheter partially or completely deflate. This would reduce the catheter's reactive force against any tissue abutting against and applying a force against the catheter. This could reduce a patient's experienced discomfort from such contact between the catheter and tissue in his or her body cavity.

Segments

FIG. 15 shows a catheter 11 having a segment 33 that physically minimizes or prevents transmission of pulses or oscillations to any surrounding tissues, that is placed along the catheter assembly such that it is between the tube and a further segment that does transmit pulsations or oscillations to surrounding tissue. Such a catheter segment would potentially not impart significant stimulation to surrounding tissue if it were to momentarily come into contact with any such tissue, or be in contact during a more extended period of time, but would not necessarily be in such contact during use due to its shape (e.g. a narrow shape).

In a similar embodiment (not shown), the catheter has one or more segments that physically minimizes or prevents transmission of pulses or oscillations to surrounding tissues, that is/are placed along the catheter such that it/they divide(s) the catheter into segment(s) that transmit pulsations to surrounding tissue.

In either embodiment, the segment that does not readily transmit oscillations should have other properties of the catheter that are conducive to introduction into a body cavity according to the invention, such as a soft and pliable material that needs fluid pressure to become rigid enough to permit introduction.

The nasal mucosa inside the nasal cavity can, as a result of and in the course of treatment, reduce its volume. It can be desirable that the catheter can expand over time such that any reduction in physical contact with the mucosa can be reduced. In one embodiment, the Catheter contains one or more elastic segments, or is elastic in its entirety, such that a higher average pressure can expand the size of the catheter during pulsative treatment and vice versa.

It can be advantageous if the catheter can be stiffened during the course of treatment, with or without any elastically expandable segments, such that contact with surrounding tissues that may have become decongested can be made stronger. Such stiffening could be achieved by increasing the pressure in the catheter, which could be achieved by controlling the vent impedance or by controlling the output from the generator. It can be advantageous if the patient receiving the treatment can easily control the average pressure during both inflation and pulsative treatment.

In embodiments where two pumps are used to provide smooth flow and pulsative flow, both pumps can be operated at the same time to provide a higher average pressure while the pulsative frequency remains unchanged. Similarly, the pressure can be lowered while maintaining the pulsative frequency if the smooth flow pump can reduce its operating speed (i.e. it is already operating), or in embodiments where the smooth flow pump can act in reverse, removing fluid from the catheter assembly. The increase in average pressure can be guided by the duration of treatment delivered or some measurement of nasal swelling (e.g. flow impedance in the catheter assembly).

With any controllable vent accessible to the patient, the patient can control the pressure in the catheter during treatment to improve comfort and/or perhaps improve treatment effectiveness by adapting according to the progress of the treatment and the body's reaction to it.

Rigid Element

FIG. 16 shows one embodiment in which the catheter 11 has one or more rigid structural element(s) 35 (such as a seam or a stiffer member) on the inside or the outside of the rim of the flat catheter that prevents flexing in certain directions but not in others. In the nasal cavity, it can be desirable that the catheter not flex in a vertical direction. The structural element(s) could be made from the same material as the catheter (e.g. constituting a thickening of the catheter wall) or from a different material.

Catheter Shape

As shown in FIG. 17, in one embodiment, the catheter 11 is relatively flat with folds 37 or protrusions on some part of one side of the catheter wall to serve to abut against the concha/turbinate in the nasal passage, if the catheter is introduced into a nasal cavity, such that the catheter is prevented from flexing or moving up or down inside a body cavity, or otherwise move into an undesirable position or move in an undesirable pattern of motion. The folds may or may not be in fluid communication with the rest of the catheter. They may structurally be more rigid or more pliable. They may or may not transmit oscillations efficiently to surrounding tissue. In embodiments where the folds are in some such communication with the mechanical oscillations carried by a fluid, the folds can contribute to the mechanical stimulation impacted on the tissue. In other embodiments, the folds are only there for their primary purpose, which is to guide the catheter into the right position in a cavity. In one embodiment, the folds are shapes.

In one embodiment, (not shown), the catheter is shaped to have a bend or curvature, such that the catheter when inserted into the nasal cavity can extend into the nasal cavity at an angle pointing upward, and then extend largely horizontally into the nasal cavity. In typical embodiments, the bend angle would be between 0-50°, and in a preferred embodiment less than 15°, and the bend is located 15-25 mm from where the invention starts passing through the nostril. The bend would in a preferred embodiment, if the catheter is mounted on a piece of tubing extending into the nasal cavity from any support structure, be located 0-20 mm from the base of the catheter such that the catheter's bend is above the internal ostium.

Catheter Fixation and Support Structure

A catheter assembly can in some embodiments contain a support structure, where the support structure is located at or in proximity to the joint between the catheter assembly's tube and its catheter.

As shown in FIGS. 10 and 11, the support structure 23 could when present act as a handle for manipulating the catheter assembly 3 or part thereof, or have a handle mounted on it for such manipulation.

Controllable vents 21 could in some embodiments be located on the support structure and in some such cases on such a handle.

As shown in FIG. 11, in some embodiments, the support structure 23 could have two knobs 25 protruding from it, in parallel with the catheter 11, such that one of the knobs, when the catheter is inside the nasal cavity, extend a short distance into the other nostril. If the catheter is moved to the other nasal cavity, the other knob similarly extends into the first nostril. The knobs serve to limit the catheter assembly's ability to move. In order for the knobs to be able to reach into a nostril, it may be advantageous if the support structure or tubing is curved such that the user's upper lip is traced, placing the knob closer to the nostril. It can be advantageous if normal breathing-related airflow through a nostril is impeded no more than necessary. In some embodiments, the knobs are hollow, or have a hollow channel or are otherwise designed to limit airflow impedance such that their airflow obstruction is minimized.

In some embodiment, the catheter assembly contains a support tube 29 which may comprise a tube, wire, string, strap of fabric, or other material that attaches to the support structure and also to the main fluid carrying tube at some point, though the main tube 27 and the support tube 29 need not be in fluid connection with each other, such that when the support structure is placed in proximity of the nose the main tube can be supported on one ear and a support tube around the other ear, such that the support structure and thus the catheter assembly is held in place on the patient. The support tube may be identical to the second fluid carrying tube. The support tube may or may not be used to deliver fluid to the catheter. It can be advantageous if the support tube is made from the same materials as the main tube, as this symmetry may facilitate use of the catheter assembly as weight, stiffness, friction and similar physical properties would be similar on both supporting ears. It is desirable that the catheter assembly and thus the catheter be held in place in such a way that the catheter is prevented from sliding out of the nasal cavity in part or in full such sliding could cause full treatment effect not to be obtained. The fixation using the ears mean that some force will hold the support structure toward the face, typically directed slightly upward on the upper lip, such that the catheter is held firmly in position in the nasal cavity One common side effect of treatment is that patients can sneeze. The fixation using the ears prevents the patient from sneezing the catheter out in such cases.

In some embodiments, a structure, e.g. made from plastic, wraps around both tubes, can slide along the tubes and will due to friction, a locking mechanism or other mechanism remain where it is left by the user along the tubes. Such a device can be used to keep the tubes together e.g. under the chin of the user such that the tubing over the ears will not get dislodged from the desired position over the ears, and/or will not move in an otherwise undesirable way.

Connectors Facilitating Fixation Etc

As shown in FIG. 23 in some embodiments, the main tube and secondary tubes have connectors 39 located typically 3-15 cm from the nose, but other positions can also be used in embodiments of the present invention, such that the support structure 23, catheter 11 and associated parts can be separated from the tubes 27 and 29 (when the system is not in use) or connected to the tubes when the system is to be used.

These connectors can preferably be of a quick connect and disconnect type. In such an embodiment, most of the tubing in the catheter assembly can be reused between treatment sessions which can be advantageous from an economic, environmental or other perspective.

In another embodiment, connectors can be permanent and not easily connectable and disconnectable.

If connectors permit free rotation, the connectors will release torsional forces in the main tube and second tube, if any, which can be advantageous as such torsional forces can twist the tubes, catheter assembly, the structural support and/or catheter such that they position the catheter in an undesirable direction in the nasal cavity or the tubes over the ears in undesirable shapes.

If the tubing connecting the connectors to the support structure is flexible, use of such connectors would permit that part of the tubing to rotate around its main axis while otherwise maintaining the same shape. This would in turn permit any support structure to rotate around the same axis.

In embodiments where the support structure is free to rotate freely or within some range along the axis formed by the tubing connecting to the support structure, e.g. if the system uses connectors and flexible tubing leading to any support structure and the catheter as described above, the angle between the plane normal to the main axis of the patient and the catheter extending into the nose (i.e. the angle by which the catheter is pointing upward) can vary within some range of degrees.

It can be advantageous if the catheter is free to move through different angles pointing upwards, as this can permit contact loop with the internal ostium, the nostril and other surfaces on and within the nose and nasal cavity to guide the catheter to assume a desirable position with very limited forces and thus very limited discomfort if any.

In some embodiments, the stretch of tubing from the connectors to the support structure could be rigid, in one or more dimensions. In some embodiments, such tubing would be supported by a structure, e.g. made from plastic, that would add stiffness to an otherwise flexible tube in a desirable dimension. In some embodiments, such rigidity would prevent the angle formed, in the plane separating the two nasal cavities, between the line from a rigid tube to a support structure and the line from the catheter to a support structure, from changing. Such fixed angles could be selected such that the angle at which the catheter is pointing up into the nasal cavity is in some range such as 0-50°, and in a preferred embodiment around 30°. It is understood that the angle depends on the angle at which the rigid tubing is held by the supporting tubes over the ears, and that this angle can vary. Angles used in embodiments of the present invention can vary. Such an embodiment could permit the system to mount the catheter in a fixed direction into the nasal cavity.

Generator System

Product System

As shown in FIG. 18, the product system includes a fluid generator 5 and one or more catheter assemblies 3, where each catheter assembly is connected to the generator through one or more of the lumina 9 in the tube 7 of the catheter assembly. The generator includes a means of producing fluid flows, smooth, pulsating or oscillating or a combination thereof that can be injected into the catheter assembly. The generator can also include means for venting fluid from the catheter assembly actively (e.g. through a pump; in some embodiments it could be a pump that is typically used for pumping fluid into the catheter assembly that can also be operated in reverse) or passively (e.g. through a vent). The generator can also include one or more pressure sensors 41 to measure the characteristics of the output fluid flow, as well as to measure pressure variations that originate in the catheter assembly. The generator can include a logic unit 43 that among other things can receive pressure sensor data, regulate the speed of one or more pumps, and/or control other actuators (e.g. valves). The logic unit may calculate desired outputs based on collected data.

Pump Configurations

If a smooth inflationary flow can be produced, a catheter can be inflated such that it becomes suitably rigid for insertion into a body cavity, potentially without or with reduced irritation, stimulation or other form of discomfort for a human or non-human subject.

In one embodiment, a generator with a single pump is used to inject fluid into a catheter assembly, such that either predominantly pulsations or predominantly smooth flow can be achieved in a controlled fashion. One way to provide different characteristics in these two modes is to vary the pump motor speed. This solution may or may not be able to generate as clearly dampened and smooth flows as other embodiments. By using a single pump to produce two or more types of flow, advantages can be obtained in terms of product cost, weight, or similar considerations.

In one embodiment, a single pump is used to generate flows for both insertion and treatment (pulsations), perhaps with different flow rates used to configure the system for more or less prominent pulsations in the flow. Such a system would generate considerable oscillating noise (i.e. pulsations) when producing flow for insertion of the catheter.

In another embodiment, a generator has a single pump that can be turned on or off, and when it is on it injects pulsating or oscillating fluid into a catheter assembly, while the catheter in the catheter assembly contains one or more rigid members such that it can be introduced in a body cavity with or without fluid flowing in the catheter assembly, and when the pulsative fluid flow is on it is inflated and delivers treatment. This embodiment can provide a cost effective, small or otherwise convenient controller design.

As shown in FIG. 19, in order to reduce oscillations or pulsations when an inflationary (smooth) flow for rigidity is desired, one or more dampening devices, e.g. Helmholtz resonators 45 or similar pulsation dampeners, can be connected to the pump 49 output tubing by means of one or more controllable valve(s) 47. By opening a valve, a single Helmholtz resonator or multiple resonators (perhaps configured in serial and/or parallel fashion), depending on its design, would be enabled to attenuate or eliminate certain frequencies in the output from the pump (centered around but not limited to the resonant frequencies). One Helmholtz resonator is tuned to damping a particular frequency to a high degree, but also tends to reduce a range of adjacent frequencies in some range. The pump speed could be controlled to match undesirable frequencies in the pump's output to the resonant frequency most desirable to eliminate or reduce.

FIG. 20 shows an embodiment in which, by having one or more variable-volume Helmholtz resonator(s) 51, the resonant frequency at and around which the resonator dampens the output can be controlled. This way, undesirable frequencies in the pump's output could be reduced or eliminated without requiring the pump 50 speed to be adjusted to match the dampening characteristics of the resonator. The regulation of the dampening could also be achieved by means of a combination of variable-volume Helmholtz resonator and variable-speed pump(s).

Another way shown in FIG. 21, or a complementary way, to dampen the oscillations or pulsations in the flow would be to include a three-way valve 53, or similar, to selectively direct the pump 50 output straight to the catheter assembly 3, or other recipient of the pump's output, or direct the pump output first through one or more muffler(s) 55 before connecting to the output. In the latter case, a check valve 47 could be desirable to prevent fluid from flowing backwards from the output to the muffler. The muffler could be a length of soft tubing, in one embodiment a silicon tube. The muffler could contain a cavity that serves to dampen certain frequencies of oscillation.

In another embodiment shown in FIG. 22, two pumps 49, 50 or more are used to produce two or more fluid flow characteristics, typically one for pulsations or oscillations, and one for smooth fluid flow. The output from both pumps could be connected to the catheter assembly, through separate lumina 7 or the same lumen.

The output from the pumps can be conditioned to meet the desirable output frequency and waveform profiles. For the pump used to produce a smooth fluid flow (e.g. a rotary diaphragm pump), means of dampening any oscillations present in the output due to the mechanical design of the pump can be desirable in order to obtain a desirable smooth output. This can be achieved e.g. by connecting the pump output to muffler(s), or by connecting Helmholtz resonator (s) 45 or other pulsation dampeners to the output. Especially in applications where the fluid flows from the pumps are mono-directional, check valves 47 can be used to prevent fluid from one pump output to flow backward through the other pump. As shown in FIG. 22, a check valve would be especially important if a Helmholtz resonator is connected to the output of one of the pumps, such that output from other pumps cannot be affected by the resonator.

By overlapping the operation of two or more pumps, smooth transitions between different fluid flow characteristics can be achieved, e.g. by increasing and/or decreasing the pump speed according to some linear or non-linear pattern during the transition phase. The transition phase typically lasts between 1 and 15 seconds.

If a mechanical valve is used to switch between different flow patterns (e.g. between smooth, pulsating or oscillating, in some combination), a smooth transition between different fluid flow characteristics could be achieved by having intermediate configurations where some part of the fluid flow is directed in one way and some in a different way, leading to a controlled combination of the two flow mode patterns.

Dynamic System Pressure

In embodiments where the catheter assembly has one or more continuously open vents, maintaining an internal pressure in the catheter assembly above ambient requires that fluid is injected into the catheter assembly continuously or with short intervals that can approximate continuity. Such dynamic pressurization, or active maintenance of pressure can be advantageous compared to static pressurization where once pressurized a system largely maintains its pressure, with pressure falling only slowly over time. Maintaining such a continuous fluid injection mechanism can be advantageous, as varying the pressure in the catheter assembly can be achieved by varying the operating speed of an already-running pump, as opposed to having to start and stop pumping action from rest, and against the pre-existing pressure in the catheter assembly, or similarly have to open and close valves to vent fluid in the system in order to lower the pressure. It can also be advantageous that in such embodiments one pump provides the mechanism for both pressurizing the catheter and making it vibrate, eliminating the need for separate mechanisms to implement these. With one or more controllable vents, the system provides a mechanism for controlling stiffness of the catheter near the catheter itself, without electrical signaling to the generator or user input through the generator's user interface. Compared to a completely rigid stimulator, the present invention also provides a mechanism for deflating the stimulating catheter which can be advantageous.

In some embodiments of the present invention, there is a mechanism, such as a pump, that can be used to actively remove fluid from the catheter assembly and so actively reduce the pressure inside the catheter assembly.

A preferred embodiment, illustrated in FIG. 23, is a system that consists of a generator 5 and a catheter assembly 3, where the generator is used to inject fluid into the catheter assembly. In typical use, during active treatment there will be an oscillating or pulsating flow such that there is a net positive fluid flow across each oscillation cycle or pulse.

The catheter assembly consists of a main tube 27 with a main single lumen and a catheter with a divided inside catheter volume that can carry fluid in a loop with fluid inflow to the volume coming from the main single first lumen and the fluid outflow escaping through a shorter second lumen that could be part of the main tube or inside a separate secondary tube 29. In a preferred embodiment, the shorter second lumen is in a secondary tube that is inside the main lumen (i.e. coaxial). In some embodiments, especially when using the coaxial configuration, the catheter volume is not explicitly divided but rather fluid must pass through some part of the catheter volume in order to go from the entry (main lumen) to exit (second lumen), creating a loop.

The catheter, when in a non-inflated state could typically be about 5-10 mm wide and about 40-100 mm long, most typically 6-8 mm wide and 70-80 mm. In embodiments for pediatric use, dimensions can be smaller based on the age of the child.

In an inflated state, the catheter could become rigid enough to support insertion into a nasal cavity which may be more difficult or impossible with no inflation.

The catheter can be made from a smooth, flexible biocompatible material, such as low- or high-density polyethylene or polyurethane. In one aspect, the material is about 50 μm thick.

The tube can be made of a flexible tubing material, that may be non-collapsible, such as PVC. The tube and the catheter can be attached to each other by several means, including mechanical friction, melting, gluing or similar adhesive process, surrounding heat shrink tubing, or a combination thereof. The tube can be connected to the generator with a quick-release connector.

In another embodiment, the generator is configured as in FIG. 3, and the catheter assembly has a single tube with a single lumen, connected to a catheter with a single catheter volume inside. One or several vents are placed on the surface of the catheter, toward the distal end.

The pulsation dampener could be a Helmholtz resonator with a cylindrical volume of about 6-100 $cm^3$, in a preferred embodiment 25 to 60 $cm^3$.

The catheter tube could be 80 cm long for embodiments where the catheter tube is not used for fixating the catheter assembly over the ears, and 120 cm when this is the case, with a single lumen inside in both cases with an inner diameter of 3.2 mm. The outer dimension is typically 4.8 mm or 6.4 mm, or similar.

In a preferred embodiment, the shorter lumen is in a secondary tube which has a smaller inner diameter than the main tube lumen, thereby providing more fluid impedance than the main tube lumen such that a suitable pressure is maintained in the catheter assembly given the provided fluid injection. The generator may be configured to provide an oscillating or pulsating fluid flow to the catheter via the main tube lumen. The capacity of the generator and the flow resistances of the first lumen and the second lumen may be selected so that fluid does not flow into the catheter via the second lumen during operation.

The main tube and/or secondary tube may extend some distance into the catheter and the catheter volumes.

The generator may comprise a pump with a flow rate of about 700-2000 ml/minute at zero pressure, and a flow rate at 100 mbar pressure of 500-1500 ml/minute.

The generator when creating a pulsating or oscillating flow, would typically have a main frequency in the range of 30-100 Hz, and typically 68 Hz.

The waveform generated as above could contain harmonic oscillations of considerable magnitude, sometimes approaching the magnitude of the main frequency, which may or may not be desirable depending on the characteristics of the disease state to be treated. It is the experience of the inventors that smaller diaphragm pump motors tend to have stronger harmonic oscillations. In some embodiments, mufflers acting as fluid low-pass filters can be used to reduce harmonics in the pulsative flow.

During insertion, the pressure in the catheter would typically be in the range of 0 to 200 mbar, and fully obstructing the outflow from the catheter assembly would typically increase the pressure within this range.

During pulsating flow, the average pressure over each cycle would typically be in the 30-100 mbar range.

The typical treatment duration is 10 minutes in each nostril, one administered immediately after the other.

When the present invention has been prototyped, the catheter has been made from two sheets of 50 μm thick LDPE that have been heat welded together using a brass hold. The catheters have then been cut along the welded seams using a cutting tool. This has provided the catheter with rigid elements along the upper and lower part of the catheter in the form of the welding seams. It is understood that the welding could be achieved by other means such as laser welding, ultrasound, or similar technique known to a person skilled in the art. The cutting could similarly be performed using a laser or other cutting technique. The welding and cutting could also be performed in one step using a heated cutting tool.

It should be understood that the embodiments and examples described in relation to a particular aspect of the invention are equally relevant, when applicable, to the other aspects of the invention.

Method of Treatment

One aspect of the invention provides a method for stimulating tissue in a body cavity of a human or other mammal. The method steps comprise inflating a flexible catheter such that it attains rigidity at least sufficient for introducing said catheter into a body cavity; introducing the catheter in its inflated state into a body cavity; and then using fluid flow to the catheter to impart vibrational energy on tissue inside the body cavity.

In some embodiments of the method according to the present invention, treatment is typically performed in the following manner: a catheter assembly is connected to a generator. The generator is made, through interaction with its user interface, to produce a continuous smooth flow of air into the catheter assembly, which conducts the flow through a constituent tube to a constituent catheter which contains a catheter volume. The flow escapes from the catheter assembly though a vent. The continuous flow of air through the catheter assembly maintains a pressure difference relative to ambient pressure, making the catheter inflate and thus providing it with some structural rigidity. The catheter assembly is held in such a way that the catheter can be easily manipulated in space, and such that the holder can easily control any controllable vents while holding the catheter assembly, thereby controlling the pressurization of the catheter. While making any desired adjustments to the pressure in the catheter, the catheter is then introduced into a first nasal cavity through its associated nostril. Once the catheter is in its correct position, the smooth flow from the generator is stopped, and instead the generator produces a pulsative flow that inflates the catheter and makes its surface oscillate mechanically. This pulsative flow typically continues for about 3-15 minutes, most often 10 minutes, after which the generator shuts down the pulsative flow and the catheter can be extracted.

In some embodiments of the present invention, after stimulation has been delivered in one nasal cavity and the Catheter has been extracted, the Catheter is then moved into position in front of the other nasal cavity and introduced into said cavity. Stimulation is then delivered into the other cavity by the same procedure as the first one.

In some embodiments of the present invention, the method for introducing the catheter into the nasal cavity does not use smooth flow to inflate the catheter, but rather pulsative flow such that some stimulation of tissue can occur during the insertion process.

In some embodiments of methods according to the present invention, after the Catheter has been inserted into the nasal cavity but before the stimulating flow has commenced, the main tube and the support tube of the catheter assembly are placed over the ears of the person who will receive the treatment, such that the catheter is held firmly inside the nasal cavity with little chance of slipping out or otherwise move to an unfavorable position.

In other embodiments of methods according to the present invention, the main tube and the support tube are placed over the ears before the catheter has been inserted into the nasal cavity, such that when the catheter is then inserted into the nasal cavity the tubes can slide over the ears and the catheter becomes fixated upon successful introduction of the catheter in the nasal cavity. In these embodiments, catheter inflation may occur before or after the main and support tubes have been placed over the ears.

When moving the catheter between nasal cavities, any tubes over the ears may or may not be removed and replaced over the ears according to the above descriptions.

Devices and methods according to the present invention can be used to have a therapeutic effect by stimulating tissue inside a body cavity of a human subject or other mammal by delivering mechanical energy to said tissue.

Tissue stimulation by the method according to the present invention can be used to stimulate lacrimal and/or meibomian gland output.

Tissue stimulation by the method of the present invention can be used to improve measures of disease status for patients with Chronic Obstructive Pulmonary Disease (COPD).

Tissue stimulation by the method of the present invention can be used to improve measures of disease status for patients with some diseases where the nervous system and/or inflammatory processes play roles, some of these diseases are mentioned in the background to the invention.

Experimental Data

The clinical efficacy of treatment using Kinetic Oscillation Stimulation (KOS) has been investigated in several published clinical studies for several indications using equipment other than embodiments of the present invention, e.g. Juto A, Juto A J, von Hofsten P, Jörgensen F., *Kinetic*

*oscillatory stimulation of nasal mucosa in non-allergic rhinitis: comparison of patient self-administration and caregiver administration regarding pain and treatment effect. A randomized clinical trial*. Acta Otolaryngol. August 2017, Ehnhage A et al, *Treatment of idiopathic rhinitis with kinetic oscillations—a multi-centre randomized controlled study*. Acta Otolaryngol, August 2016, Juto J E, Hallin R G. *Kinetic oscillation stimulation as treatment of acute migraine: a randomized, controlled pilot study*, Headache, January 2015, and Juto J E, Axelsson M. *Kinetic oscillation stimulation as treatment of non-allergic rhinitis: an RCT study*. Acta Otolaryngol, May 2014.

The present invention is intended to solve some of the problems regarding convenience, cost and other aspects of existing systems for delivering KOS.

A system according to the present invention has been used in a series of six patients with COPD. Each patient received 10 treatment sessions, each consisting of 10 minutes of KOS in each nostril, over a period of three weeks. Results were measured using questionnaires, Six Minute Walking Test and spirometry. Measurements were made 1-7 days following the last treatment. Five out of six patient reported improved symptom scores following the 10 treatments, with the average COPD Assessment Test (CAT) score improving 26%. The average walking distance increased 13% (47 meters). The average Forced Expiratory Volume in 1 Second (FEV1) increased by 110 ml (4.5%), with improvements in four out of six patients. Vital capacity increased by an average of 4.4%.

Pre-clinical experiments with rat models using a design analogous to the present invention but adapted for use in rats have demonstrated reduced inflammation and reduced tissue damage in some models of disease states.

The invention claimed is:

1. A method of stimulating nasal tissues using a system comprising a catheter assembly connected to a fluid flow generator, wherein the catheter assembly comprises:

a generally oblong inflatable catheter defining at least one catheter volume; and a tube part comprising at least one lumen configured to establish fluid flow connection between said fluid flow generator and catheter, wherein said catheter is attached to a distal end of the tube part and in a first, non-inflated state is unable to support a shape of the catheter for insertion into a nasal cavity, wherein said catheter is configured to be inflated to a second, inflated state for insertion into the nasal cavity, and to a third, pulsating state for stimulating a nasal tissue, wherein no part of said tube part extends into an inflatable part of the catheter, wherein the method comprises the steps of:

providing a fluid flow from the fluid flow generator;

inflating the catheter to the second, inflated state for insertion in the nasal cavity;

inserting the catheter to a predetermined position in a nasal cavity;

adjusting the catheter with the fluid flow regulator to the third, pulsating state for stimulating the nasal tissue; and stimulating the nasal tissue by selecting at least one of a smooth continuous fluid flow, an oscillating fluid flow and a pulsating fluid flow.

2. The method according to claim 1, comprising providing a smooth continuous fluid flow when inflating the catheter and/or inserting the catheter in the nasal cavity.

3. The method according to claim 1, comprising providing an oscillating fluid flow and/or a pulsating fluid flow when inflating the catheter and/or inserting the catheter in the nasal cavity.

4. The method according to claim 1, comprising stimulating the nasal tissue with an oscillating fluid flow and/or a pulsating fluid flow for 3 to 15 minutes or at least 10 minutes.

5. The method according to claim 1, comprising controlling the catheter pressure and/or the catheter rigidity with at least one controllable vent.

6. The method according to claim 5, comprising stimulating the nasal tissue while admitting a fluid flow to exit from the at least one controllable vent.

7. The method according to claim 1, comprising stabilizing the catheter assembly over the ears.

8. The method according to claim 1, wherein the fluid flow generator is operated with a fluid flow rate of 700 to 2000 ml/min at 0 mbar pressure and 500 to 1500 ml/min at 100 mbar pressure.

9. The method according to claim 1, wherein the fluid flow generator is operated to create a pulsating or oscillating flow with a main frequency in the range of 10 to 100 Hz.

10. The method according to claim 1, wherein inflating the catheter to the second, inflated state and inserting the catheter to a predetermined position in a nasal cavity, is performed consecutively or at least partly simultaneously.

* * * * *